US011304474B2

(12) United States Patent
Luna

(10) Patent No.: US 11,304,474 B2
(45) **Date of Patent: *Apr. 19, 2022**

(54) CONSTRUCTION UNIT AND DECORATIVE COMPONENT, AND A SHOE INCORPORATING SAME

(71) Applicant: Fashion Lane Holdings LLC, Las Vegas, NV (US)

(72) Inventor: Sergio Luna, Las Vegas, NV (US)

(73) Assignee: FASHION LANE HOLDINGS LLC, Las Vegas, NV (US)

( * ) Notice: Subject to any disclaimer, the term of this patent is extended or adjusted under 35 U.S.C. 154(b) by 120 days.

This patent is subject to a terminal disclaimer.

(21) Appl. No.: 16/983,773

(22) Filed: Aug. 3, 2020

(65) Prior Publication Data

US 2020/0359732 A1 Nov. 19, 2020

Related U.S. Application Data

(63) Continuation-in-part of application No. 16/735,680, filed on Jan. 6, 2020, now Pat. No. 10,729,207, and a continuation-in-part of application No. PCT/US2020/028739, filed on Apr. 17, 2020, which is a continuation-in-part of application No. 16/735,680, filed on Jan. 6, 2020, now Pat. No. 10,729,207.

(60) Provisional application No. 62/837,374, filed on Apr. 23, 2019.

(51) Int. Cl.

| | |
|---|---|
| ***A43B 23/24*** | (2006.01) |
| ***A43B 3/00*** | (2022.01) |
| ***A43B 13/12*** | (2006.01) |
| ***A43B 21/24*** | (2006.01) |
| ***A43B 7/38*** | (2006.01) |
| ***A43B 3/24*** | (2006.01) |

(52) U.S. Cl.

CPC ..... *A43B 3/0084* (2013.01); *A43B 3/0078* (2013.01); *A43B 3/246* (2013.01); *A43B 7/38* (2013.01); *A43B 13/122* (2013.01); *A43B 21/24* (2013.01); *A43B 23/24* (2013.01)

(58) Field of Classification Search

CPC ..... A43B 3/0078; A43B 3/24; A43B 3/246; A43B 23/24; A43C 19/00

USPC ..... 36/25 R, 15, 136

See application file for complete search history.

(56) References Cited

U.S. PATENT DOCUMENTS

| | | | |
|---|---|---|---|
| 2,640,283 | A | 6/1953 | Joses |
| 3,082,556 | A | 3/1963 | Saul et al. |
| 3,402,485 | A | 9/1968 | Mcmorrow |
| 3,538,628 | A | 11/1970 | Einstein, Jr. |

(Continued)

OTHER PUBLICATIONS

International Search Report and Written Opinion dated May 22, 2020 for corresponding Application No. PCT/US2020/028739.

*Primary Examiner* — Marie D Bays
(74) *Attorney, Agent, or Firm* — Connie R. Masters

(57) ABSTRACT

A footwear construction unit for receiving a decorative component is provided along with an embellished shoe that incorporates the construction unit. The construction unit comprises an upper body and a weight-bearing peripheral wall extending downwardly from the upper body, which together define an interior upraised area that accommodates at least a portion of the decorative component. Thus, the decorative component is elevated above the walking surface and protected from dirt and abrasion. The decorative component may optionally extend across the arch and/or down the inner heel and/or onto other surfaces herein disclosed.

23 Claims, 24 Drawing Sheets

(56) References Cited

U.S. PATENT DOCUMENTS

| | | | |
|---|---|---|---|
| 4,050,167 | A | 9/1977 | Senter |
| 4,712,314 | A | 12/1987 | Sigoloff |
| 5,331,753 | A | 7/1994 | Rodibaugh |
| 5,533,280 | A | 7/1996 | Halliday |
| 6,389,712 | B1 | 5/2002 | Schelling |
| 6,442,869 | B2 | 9/2002 | Coomes |
| 6,813,847 | B2 | 11/2004 | Workman |
| 7,246,453 | B2 | 7/2007 | Kim |
| 7,721,470 | B2 | 5/2010 | Long |
| 2001/0042319 | A1 | 11/2001 | Coomes |
| 2004/0088883 | A1 | 5/2004 | Workman |
| 2005/0120589 | A1 | 6/2005 | Coomes |
| 2006/0042119 | A1 | 3/2006 | Workman et al. |
| 2007/0227039 | A1 | 10/2007 | Chaney et al. |
| 2013/0042422 | A1 | 2/2013 | Neal |
| 2016/0007678 | A1 | 1/2016 | Silverman |
| 2016/0015130 | A1 | 1/2016 | Knox |
| 2017/0119105 | A1 | 5/2017 | Perry et al. |

CONSTRUCTION UNIT AND DECORATIVE COMPONENT, AND A SHOE INCORPORATING SAME

CROSS-REFERENCE TO RELATED APPLICATIONS

This application is a continuation-in-part of U.S. patent application Ser. No. 16/735,680 filed on Jan. 6, 2020 (issued Aug. 4, 2020 as U.S. Pat. No. 10,729,207) which claims priority to U.S. Provisional Patent Application No. 62/837,374 filed on Apr. 23, 2019 and is a bypass continuation-in-part of co-pending PCT/US20/28739 filed on Apr. 17, 2020, which are all incorporated herein in their entirety.

FIELD OF INVENTION

This invention relates generally to footwear, and, more particularly, to a footwear construction unit with an upraised area in the underside for receiving a decorative component and to a shoe incorporating both the footwear construction unit and the decorative component installed in the upraised area.

BACKGROUND OF THE INVENTION

Shoes can not only protect the foot while walking but can also enhance a fashion ensemble or provide an avenue for personal expression. Shoes vary in style from sporty to casual to formal. Not only are the shoe uppers provided in a variety of styles and with a variety of embellishments, it is known in the prior art to incorporate interesting or enhancing designs in the shoe outsole. For example, an outsole may have treads that will print out an appealing design, a figure, a print, a symbol, or a message on a soft walking surface.

Yet outsoles are limited in their decorative aspects due to the fact that the outsole provides a flat surface that touches the ground or floor and that bears the weight of the wearer. Any decoration on the bottom of the sole will become soiled. Boggs, et al. attempted to overcome this problem in PCT Application No. WO2009026373 that discloses an outsole having a clear outer layer through which an underlying decorative surface layer can be viewed. However, the clear outer layer will become dirty during the wearing of the shoes, which will obscure the decorative underlayer and make it unattractive for viewing.

Accordingly, there is a need for a footwear construction unit to create decorative footwear with an underside carrying a decorative element, which adds interest and appeal to the overall look of the shoe but which is not soiled by touching the walking surface and which is not obscured by the soiling of a clear overlayer. Additionally, there is a need for shoe incorporating the footwear construction unit.

BRIEF SUMMARY OF THE INVENTION

The present invention is directed to a footwear construction unit that accommodates a decorative component, is directed to a structural assembly that includes both the construction unit and decorative component, and is also directed to an embellished shoe incorporating the structural assembly. The decorative component, when installed, is at least partially disposed within a raised lower portion of the construction unit, which supports the decorative component suspended or elevated above the ground. Due to the decorative component's placement in the upraised area, it does not touch the ground, thereby preventing damage or abrasion to the decorative component.

In some aspects of the invention, the decorative component extends beyond the upraised portion of the construction unit to cover all or part of the bottom surface of the arch and/or to cover all or part of the bottom surface of the remainder of the shoe, such as the inner surface of the heel (heel breast) or a portion of the heel seat surrounding the heel of the shoe.

The embellished shoe includes at least a heel section, a toe section, an arch section disposed between the heel and toe sections, a shoe upper, the decorative component, and at least one construction unit configured with an upraised area to receive at least a portion of the decorative component. In the first embodiment, the construction unit is a toe construction unit that, when integrated into the finished shoe, is positioned in the toe section of the shoe and is sized, shaped, and configured to fit below the toe portion of a shoe. In a second embodiment of the invention, the construction unit may be a heel construction unit positioned in the heel section of the shoe. The heel construction unit is sized, shaped, and configured to fit below the heel portion of a shoe. In an aspect of the invention, one (toe or heel) construction unit may be used to form the embellished shoe. In another aspect of the invention, two (toe and heel) construction units may be used to form the embellished shoe.

The footwear construction unit includes an upper body and a vertically-extending, weight-bearing peripheral wall extending downwardly below, and providing support and underpinning to, the upper body portion of the construction unit. The peripheral wall extends vertically from the bottom of the upper body of the construction unit to the ground upon which the user walks.

The peripheral wall of the toe construction unit terminates rearwardly at a right back wall margin and at a left back wall margin with a rearward gap defined between the right and left wall margins. The rearward gap allows viewing of the decorative component that is disposed within the interior upraised area. The bottom of the upper body (forming the upper body roof) and the inner surface of the peripheral wall (forming the sides) together define the interior upraised area that accommodates the decorative component. The upraised area may be shallow or deep. Based on considerations such as artistic design, materials used, and structural stability, the peripheral wall may be thin or relatively thick, may be a single wall, may be a double wall, may be a segmented wall, or may be perforated with cavities or hollows. The peripheral wall may be solid or may have cutouts, slits, or other wall openings that enhance ornamentation but still provide support for the user to allow walking. A thicker peripheral wall provides a larger surface area to contact the walking surface for stability, but a thinner peripheral wall allows for a larger area available for application of, and viewing of, the decorative component.

The disposition of a decorative element within the protected, upraised area near the bottom of the shoe allows viewing of the decorative element (for example, from behind, at a side angle, or when the wearer is seated) while protecting it from the dirt and grime of a walking surface. The decorative element may be flat or may have a three-dimensional appearance or characteristics. The decorative element is elevated so that it does not come into contact with the ground.

In an aspect of the invention (when the construction unit is incorporated into a shoe), the top of the construction unit lies generally in a first, upper plane (near or adjacent to the bottom of the shoe upper). The bottom of the construction unit upper body and the top of the peripheral wall lie generally in a second (middle) plane. And the weight-bearing peripheral wall comprises a framework that runs along the sides and front of the periphery of the upper body and extends downwardly to terminate in a bottom boundary lying in a third (lower) plane.

In another aspect of the invention, the peripheral wall comprises multiple walls that extend downwardly from at least one of the sides and/or the front of the periphery of the upper body of the construction unit and that extend downwardly to terminate in a multi-segment bottom boundary lying in the third, lower plane, as seen in FIG. 14.

In an additional aspect of the invention, the peripheral wall flares at or near the bottom boundary, which increases the surface area for engagement with the walking surface, as compared to a peripheral wall that does not have the flared portion and does not become thicker at the bottom.

In a further aspect of the invention, the decorative component is disposed only in the upraised area defined by the upper body inner roof surface and the inner peripheral wall surface of the construction unit.

In another aspect of the invention, the decorative component is disposed in the upraised area of the construction unit and extends across the sole of the arch of the shoe.

In an additional aspect of the invention, the decorative component is disposed in the upraised area of the construction unit, extends across the arch of the shoe, and extends down the inner surface of the heel of the shoe.

In a further aspect of the invention, the decorative component is disposed on the roof portion of the upraised area of the construction unit.

In another aspect of the invention, the decorative component is disposed on the roof portion of the upraised area of the construction unit and is also disposed on the interior wall surface of the peripheral wall.

In an additional aspect of the invention, the decorative component is disposed in the upraised area of the construction unit and is also disposed in a portion of the heel of the shoe.

In a further aspect of the invention, the decorative component is disposed on a portion of a heel seat surrounding the heel of the shoe.

In an additional aspect of the invention, the upraised area of the construction unit has a height that is greater than the height of the upper body of the construction unit.

In another aspect of the invention, the upraised area of the construction unit has a height that is less than the height of the upper body of the construction unit.

In an additional aspect of the invention, the upraised area of the construction unit has a height that is equal to the height of the upper body of the construction unit.

In a further aspect of the invention, a single construction unit is incorporated into the toe of an embellished shoe of the present invention.

In another aspect of the invention, both a toe construction unit and a heel construction unit are incorporated into the embellished shoe of the present invention.

In an additional aspect of the invention, the embellished shoe of the present invention is a high-heeled type shoe.

In a further aspect of the invention, the embellished shoe of the present invention is a low-heeled type shoe.

In another aspect of the invention, the construction unit includes a tread portion disposed at the bottom boundary of the peripheral wall.

In an additional aspect of the invention, the construction unit comprises an upper shoe-unit interface, a modified construction unit, and a foundational base.

In another aspect of the invention, the peripheral wall terminates in a left margin and a right margin that are tapered vertically.

In a further aspect of the invention, the peripheral wall terminates in a left margin and a right margin that are of consistent width.

In an additional aspect of the invention, an encasement is provided for attachment over at least the body inner roof surface.

In another aspect of the invention, the decorative component is fixedly attached to the outside of the encasement.

In a further aspect of the invention an inlay is fixedly attached to at least a portion of the outside surface of the encasement.

In an additional aspect of the invention, the construction unit is formed unitarily as a single piece.

In another aspect of the invention, the construction unit is formed of multiple, fixedly connected pieces.

The object of the invention is to provide a construction unit and a shoe incorporating the construction unit along with a decorative component which gives an improved performance over the above described prior art.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Shown throughout the figures, the present invention is directed toward a footwear construction unit for receiving a decorative component and toward an embellished shoe utilizing the footwear construction unit and the decorative component. The decorative component is disposed in at least an upraised portion of the construction unit, which protects the decorative component from dirt and abrasion because it is elevated above the walking surface. In one aspect of the invention, the decorative component extends from the roof of the upraised portion of the construction unit across the arch portion of the shoe sole and further to the inner portion of the heel of the shoe. In another aspect, the decorative component also extends vertically down the inner surface of the peripheral wall of the construction unit. In a further aspect, the decorative component may be disposed on a portion of a heel seat exterior of an attached heel.

Figure 1:
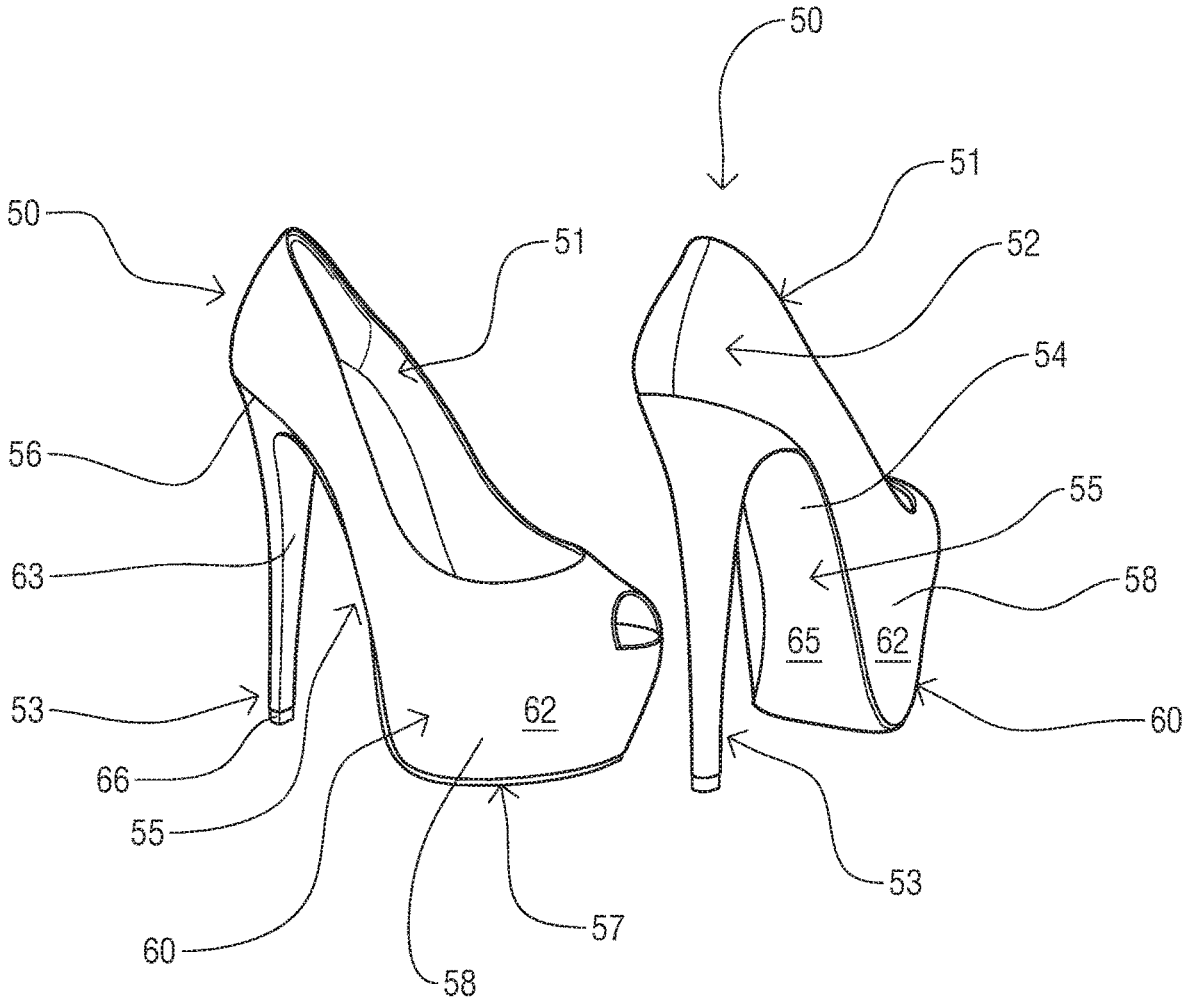
FIG. 1 Prior Art
FIG. 1 is a perspective view of a pair of prior art high-heeled shoes.

Referring now to the drawings, a conventional shoe 50 of the prior art is shown in FIG. 1. The prior art shoe 50 includes a heel 53, a toe 60, an arch 55, an outsole 65, and an upper 51.

The upper 51 defines a volume for partially enclosing a wearer's foot and typically includes an upper outer covering 52 (such as leather, imitation leather, fabric, or the like) and may optionally include an insole 69 disposed to cover the footbed of the upper 51 for comfort of the wearer. The upper 51 may be a portion of a shoe of any type, such as a dress shoe, loafer, mule, boot, bootie, sandal, thong, or the like. The upper 51 may be joined to the heel 53 at heel-upper joint 56. The heel 53 provides support for the heel portion of the upper, and in most aspects of the invention it also elevates it.

The heel 53 may be a high heel, as illustrated in FIG. 1, or a medium, low, or flat heel. The outsole 65 forms the finished bottom of the shoe 50 including the walking surface and may also comprise one or more midsole layers (not shown). The outsole 65 may include any or all of a toe outsole 57 below the toe section 60, an arch outsole 54 below the arch section 55, an inner heel breast 63 covering, and a heel cap 66 disposed at the bottom surface of the heel 53. In a high-heeled shoe, as illustrated, the inner heel covering material may extend down the heel breast 63, the inward surface of the heel 53. In some aspects of the invention, a platform 58 may be disposed at the lower part of the toe section 60, as in the exemplary high-heeled shoe illustrated, and may serve to elevate the toe portion of the upper for aesthetic reasons. In this case, toe platform covering material 62 may be disposed on the outer surface of the platform 58 to coordinate with or contrast with the rest of the shoe 50 or to otherwise enhance the look of the shoe 50.

Figure 2:
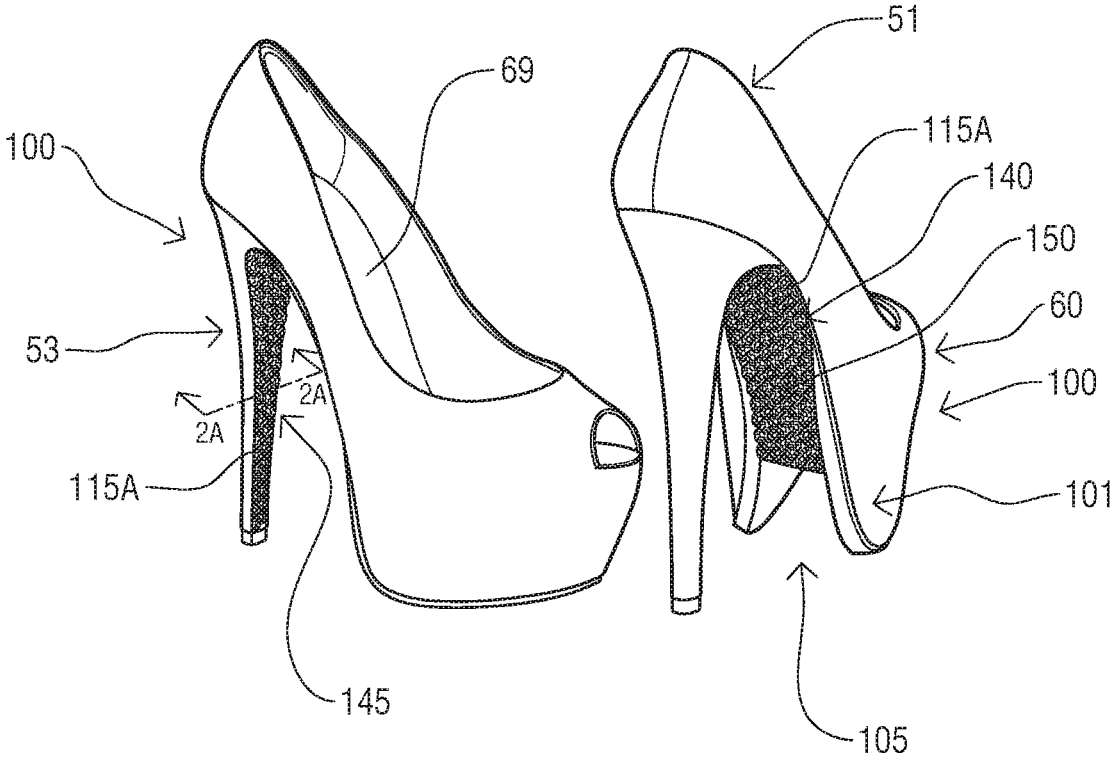
FIG. 2 is a perspective view of a first embodiment of the embellished high-heeled shoe of the present invention constructed with a toe construction unit having a tall weight-bearing peripheral wall and an upraised portion accommodating a decorative component, where the decorative component covers the floor of the upraised portion, the arch, and the inner forward-facing, breast portion of the heel.

In FIG. 2, an embellished shoe, shown generally as reference number too, is illustrated in accordance with a first embodiment of the present invention. As shown, the embellished shoe 100 comprises the heel 53, toe 60, arch 55, and an upper 51 of the prior art shoe 50, and also comprises a shoe structural assembly that includes both a decorative component 150 and a construction unit 110. The construction unit 110 is configured with an upraised area 105 (FIGS. 2, 4-5) for receiving at least a portion of the decorative component 150. The decorative component 150 may be disposed on part or all the undersurfaces of the shoe toe 60, arch 55, and/or breast 63 (inner portion of heel 53) and may comprise a toe decorative section 155, arch decorative section 140, and/or heel decorative section 145.

Figure 6:
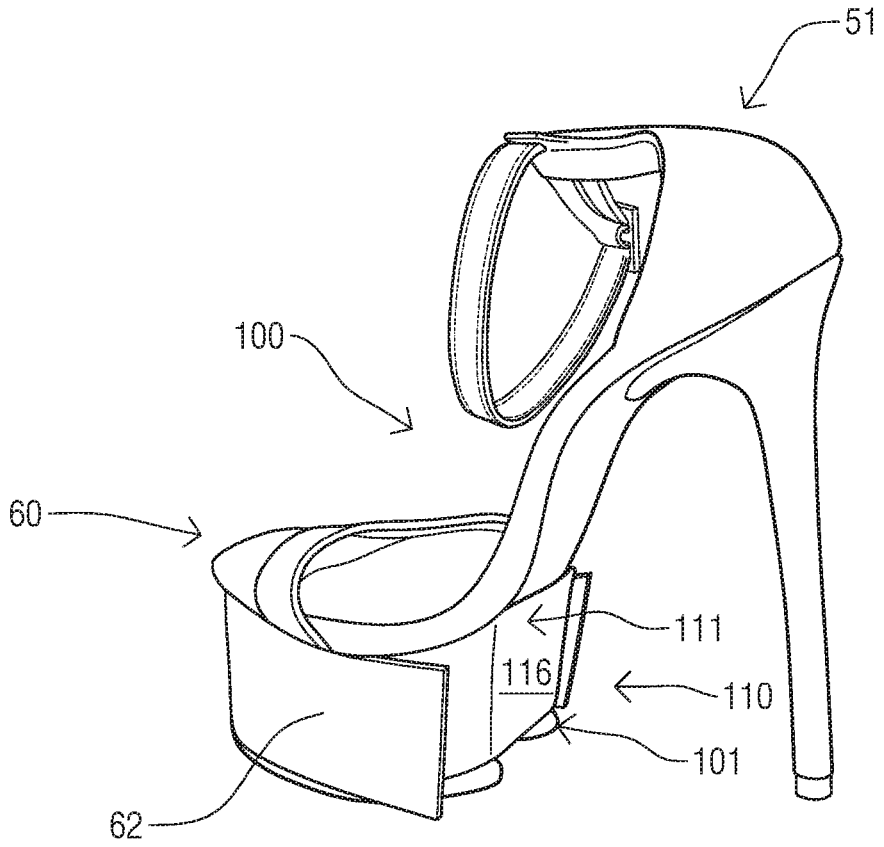
FIG. 6 is a perspective view of a partially assembled embellished shoe of the present invention that incorporates a toe construction unit having a short peripheral wall of the present invention.
Figure 9:
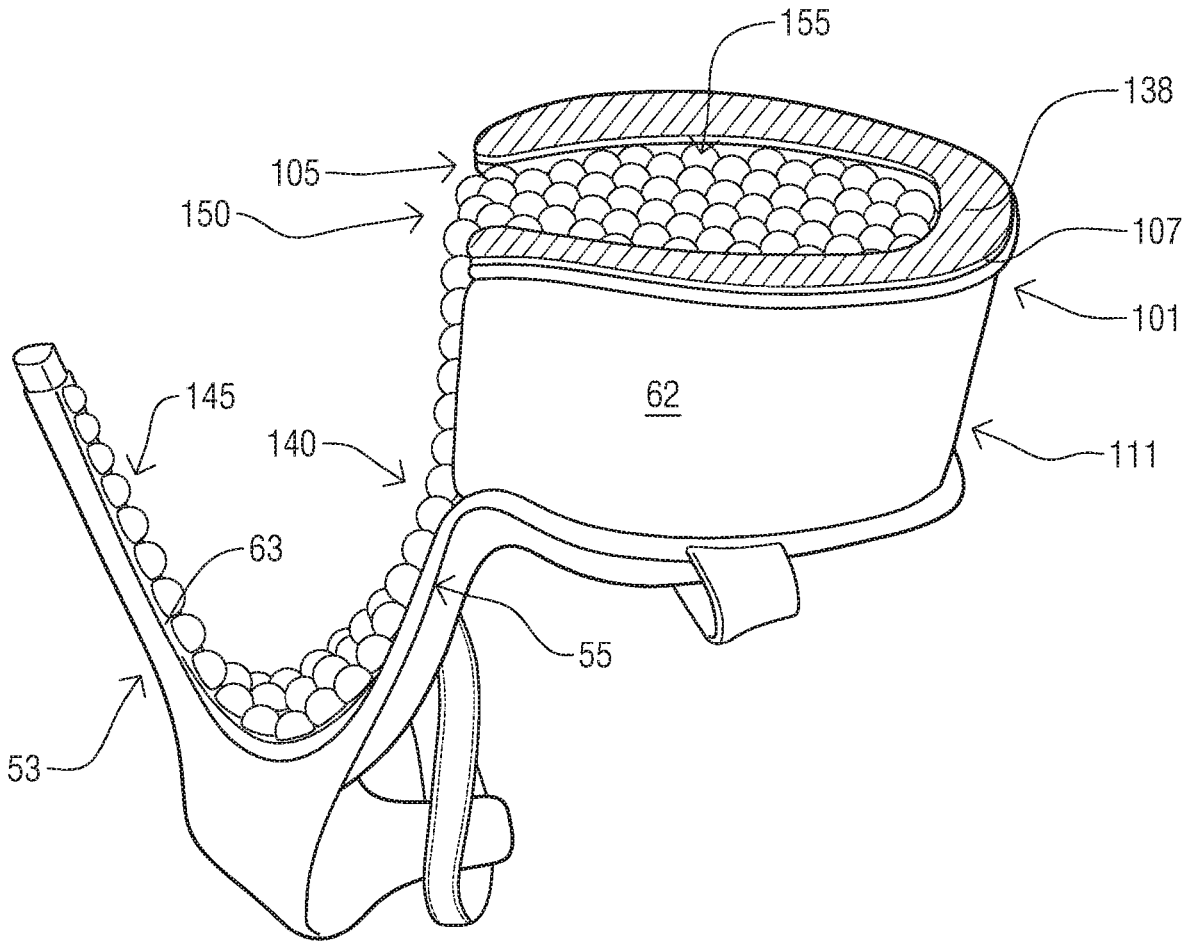
FIG. 9 is a perspective view of the bottom of the embellished shoe of the present invention that includes a construction unit with a short peripheral wall.
Figure 12:
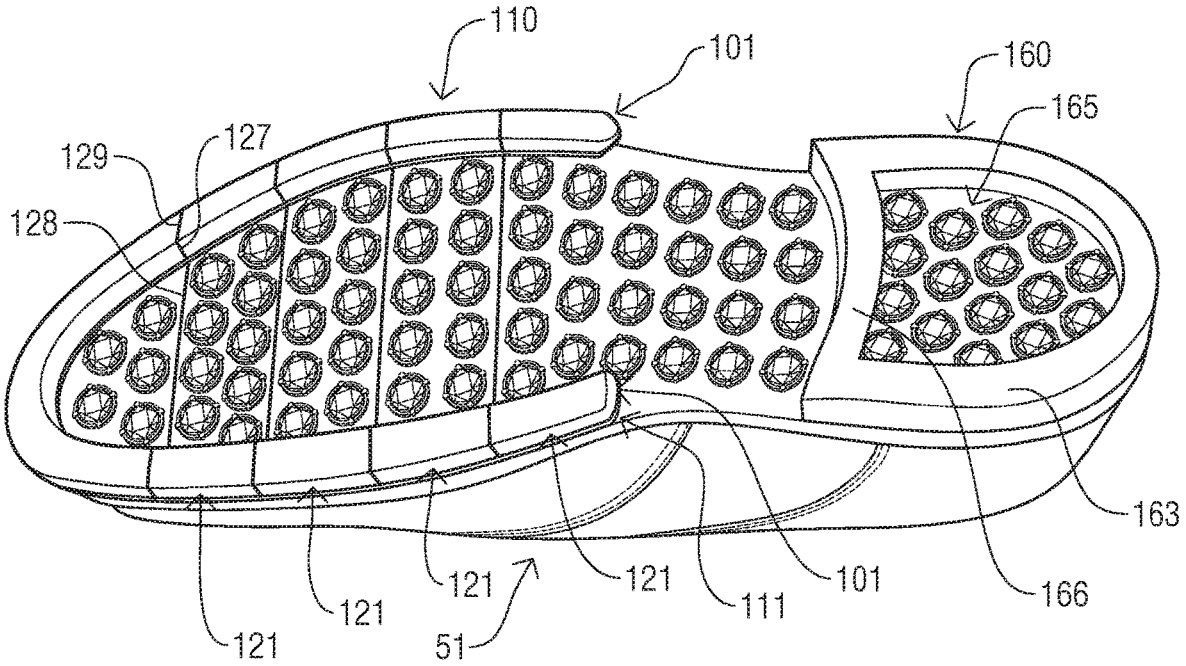
FIG. 12 is a perspective view of the bottom of a flat-heeled embellished shoe of an embodiment of the present invention having both a toe construction unit and a heel construction unit.
Figure 13:
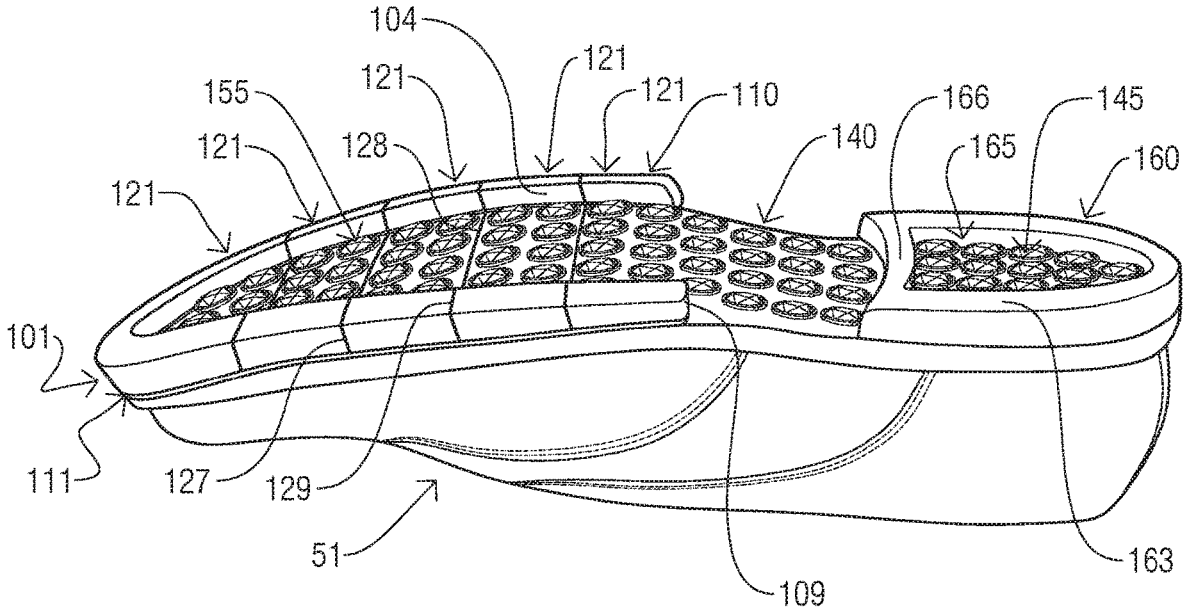
FIG. 13 is a side perspective view of the flat-heeled embellished shoe of the embodiment of the present invention that includes both a toe construction unit and a heel construction unit.

In a first embodiment of the invention, a single construction unit 110 (a toe construction unit) is utilized to form the embellished shoe 100 (FIGS. 2, 6, 9). In a second embodiment of the invention, as seen in FIGS. 12-13, both a toe construction unit 100 and a heel construction unit 160 (FIGS. 12-13) are utilized to form the embellished shoe 100.

Figure 3:
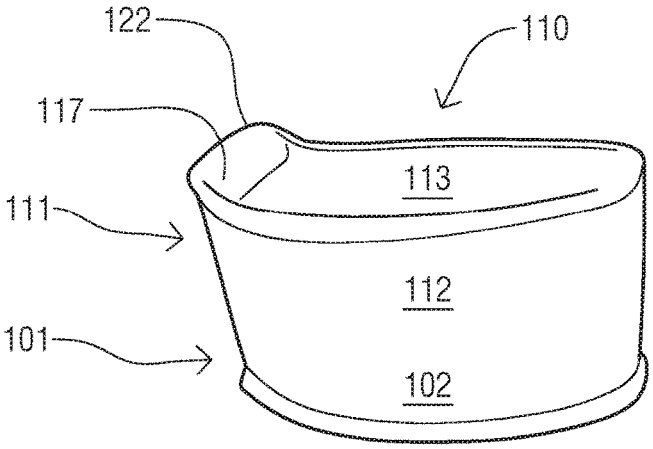
FIG. 3 is a top perspective view of the right side of the toe construction unit of the present invention that is used in the construction of the embellished shoe of the present invention.
Figure 4:
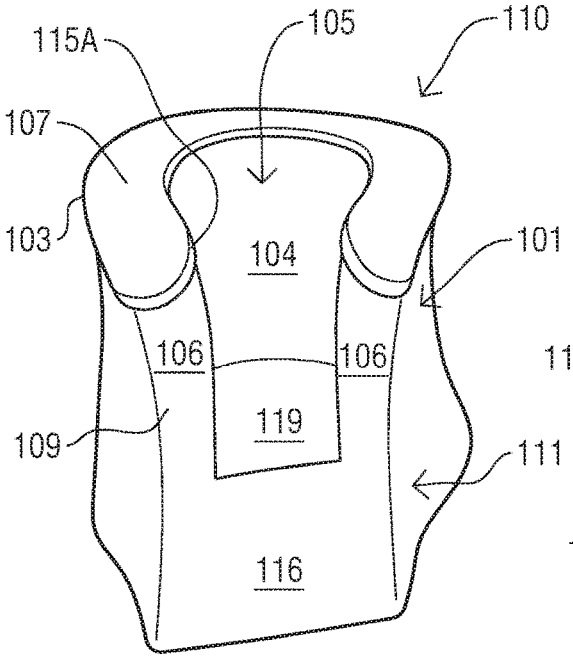
FIG. 4 is a perspective back view of the bottom of the toe construction unit of the present invention that has a tall weight-bearing peripheral wall and that is used in the construction of the embellished shoe of the present invention.
Figure 5:
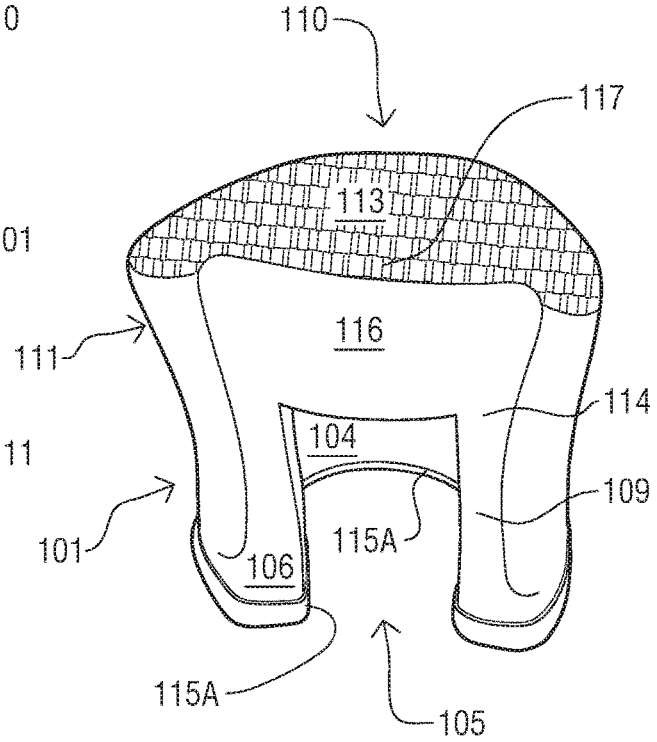
FIG. 5 is a perspective back view of the top of the toe construction unit of the present invention that has a tall weight-bearing peripheral wall and that is used in the construction of the embellished shoe of the present invention.
Figure 7:
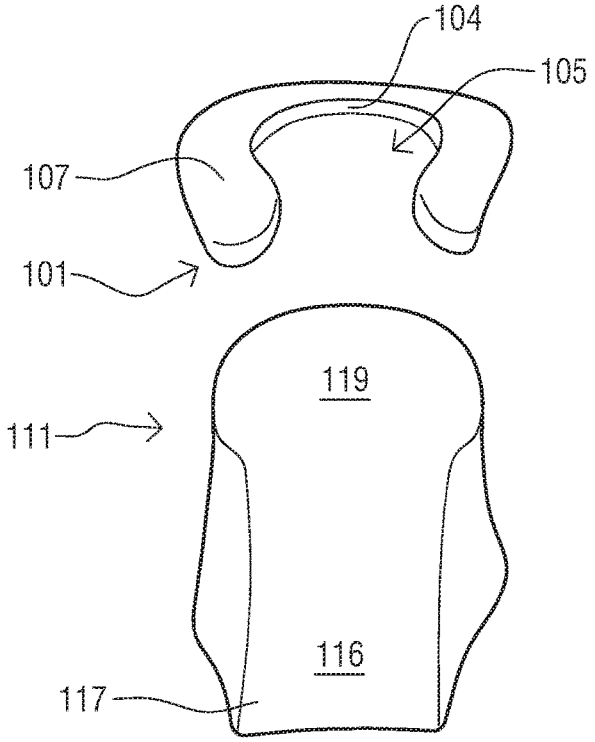
FIG. 7 is an expanded perspective back view of the bottom of a two-piece toe construction unit of the present invention with a short peripheral wall.

As seen in FIGS. 3-5, the construction unit 110 comprises an upper body in and a lower weight-bearing peripheral wall 101, which, in a preferred aspect, are formed unitarily. In another aspect, shown in FIG. 7, they may be formed separately and fixedly attached.

Figure 8:
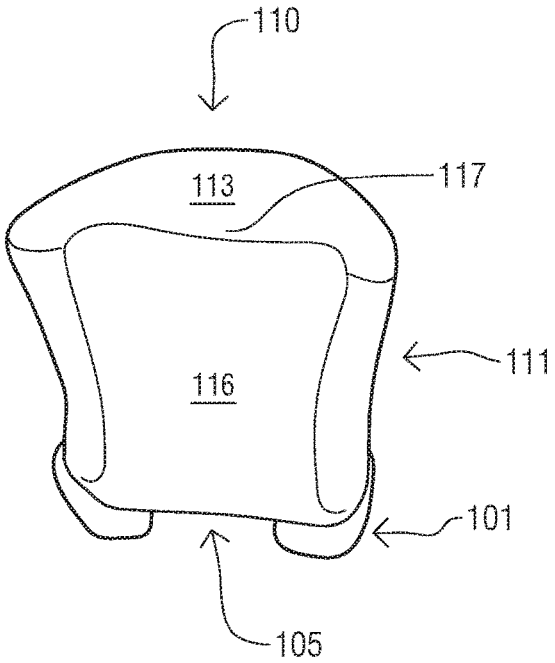
FIG. 8 is a perspective back view of the top of a toe construction unit of the present invention with a short peripheral wall.

In the finished shoe, a construction body top surface 113 (FIGS. 3, 5, 8), which is the top surface of the upper body 111 portion of the construction unit, is fixedly attached to the bottom of the toe upper portion at an upper first level. Various standard shoe elements may be incorporated into the upper 51 or disposed between the upper 51 and the body top surface 113, such as midsoles, outsoles, portions of the upper, and other elements as known in the art. The body top surface 113 may be configured to enhance the adherence of the top body surface 113 to the toe upper portion. A bonding agent may be used with or without additional mechanical devices. For example, the body top surface 113 may be irregular. The top body surface 113 may be textured or scored or otherwise treated to increase the surface area to enhance bonding, as shown in FIG. 5. The body top surface 113 may be configured with concave dimples to be received by corresponding convex hollows within the toe upper portion. Or the body top surface 113 and the toe upper portion may be configured with channels 157, 158 (FIG. 17) for receiving monofilament 159 to tie the parts together.

The upper body in of the construction unit extends vertically downward from a body top surface 113 to an intersectional area 114 (FIG. 5) that is generally at the level of the body inner roof surface 119. The peripheral wall 101 extends downwardly from the intersectional area 114 to the ground.

The upper body 111 of the construction unit extends horizontally from front to back from a body front surface 118 (FIG. 14) to a body back surface 116 ((FIG. 5) and extends horizontally from side to side between right and left lateral body lateral outer surfaces 112 ((FIG. 3). The peripheral wall 101 extends downwardly from the periphery of the sides and front of the upper body 111 to the ground. The thickness of the peripheral wall 101 is the distance between the peripheral wall exterior surface 102 (FIG. 3) and the peripheral wall interior surface 104 (FIGS. 4-5). This thickness may vary in portions of the peripheral wall 101 or remain constant throughout the entirety of the peripheral wall 101. In one aspect, the peripheral wall 101 is thin but expands outwardly slightly at the out the bottom to form a flare 103 (FIGS. 4-5). If the thickness of the wall 101 is thin, more space is allowed, which can accommodate the decorative component 150, while maintaining the functionality of bearing the weight of the wearer. In another aspect of the invention shown in FIG. 25, the wall 101 is thick, which reduces the space for the decorative component 150 but increases the area of the bottom boundary 107. The wall 101 surrounds the body inner roof surface 119 that is at the second (middle) level, which is lower than the upper first level at the body top surface 113.

The peripheral wall 101 ends at the back on the right and on the left at the right and left peripheral back margins 109 (FIGS. 4-5). An open space is defined between the right and left peripheral back margins 109, and there is no peripheral wall 101 extending downwardly from the center of the back of the upper body 111. This creates the open space between the right and left peripheral back margins 109 (FIGS. 4-5), which allows viewing of the decorative component 150 (which will be disposed within the interior upraised area 105). In a preferred aspect, the right, front, and left exterior surface 102 of the peripheral wall 101 substantially aligns with the body right outer surface 112, the body front surface 118, and the body left outer surface 112, thereby giving a smooth, finished look.

Figure 15:
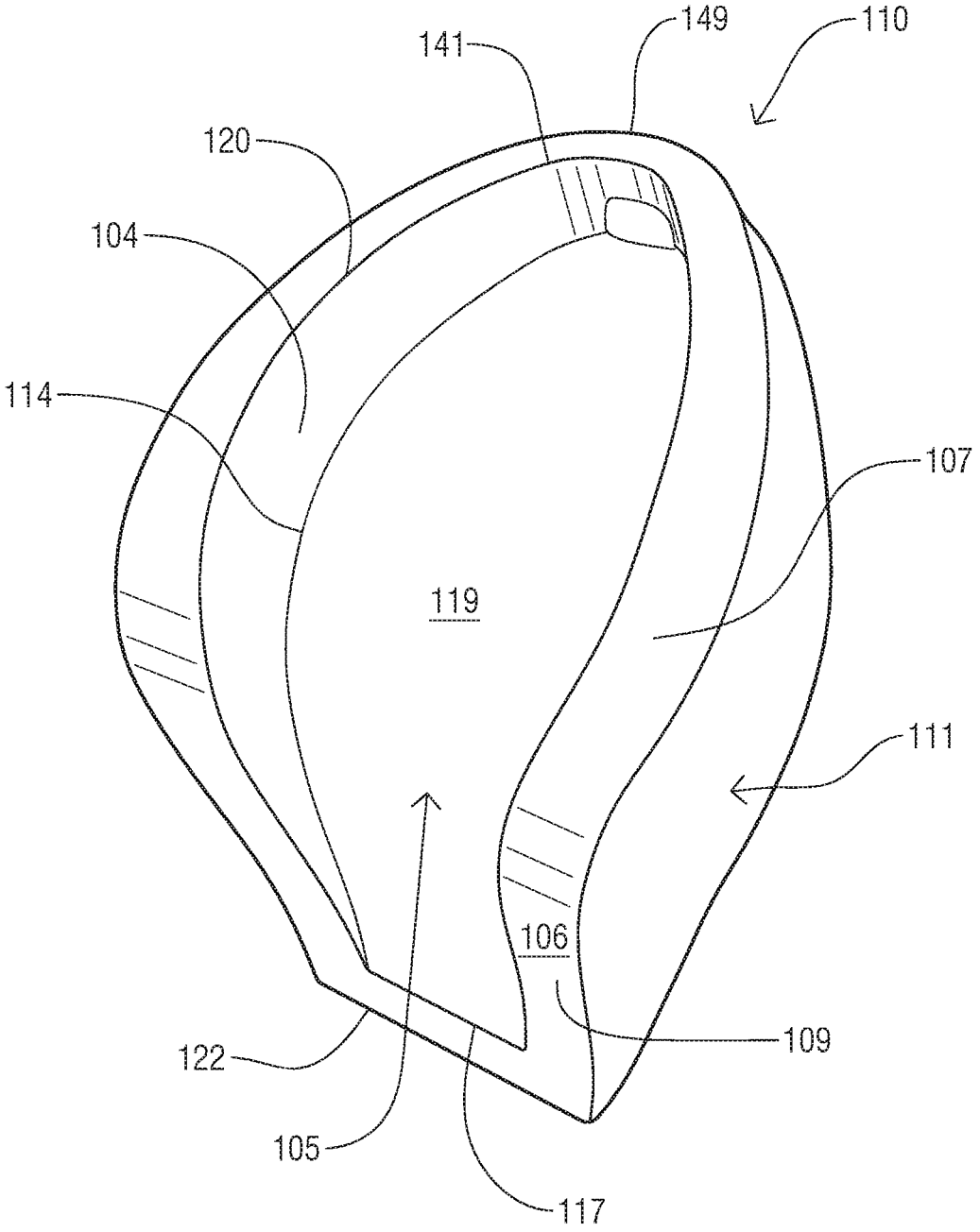
FIG. 15 is a perspective back view of the bottom of the construction unit of the present invention with a peripheral wall terminating in a right and left back wall margin of consistent width.
Figure 25:
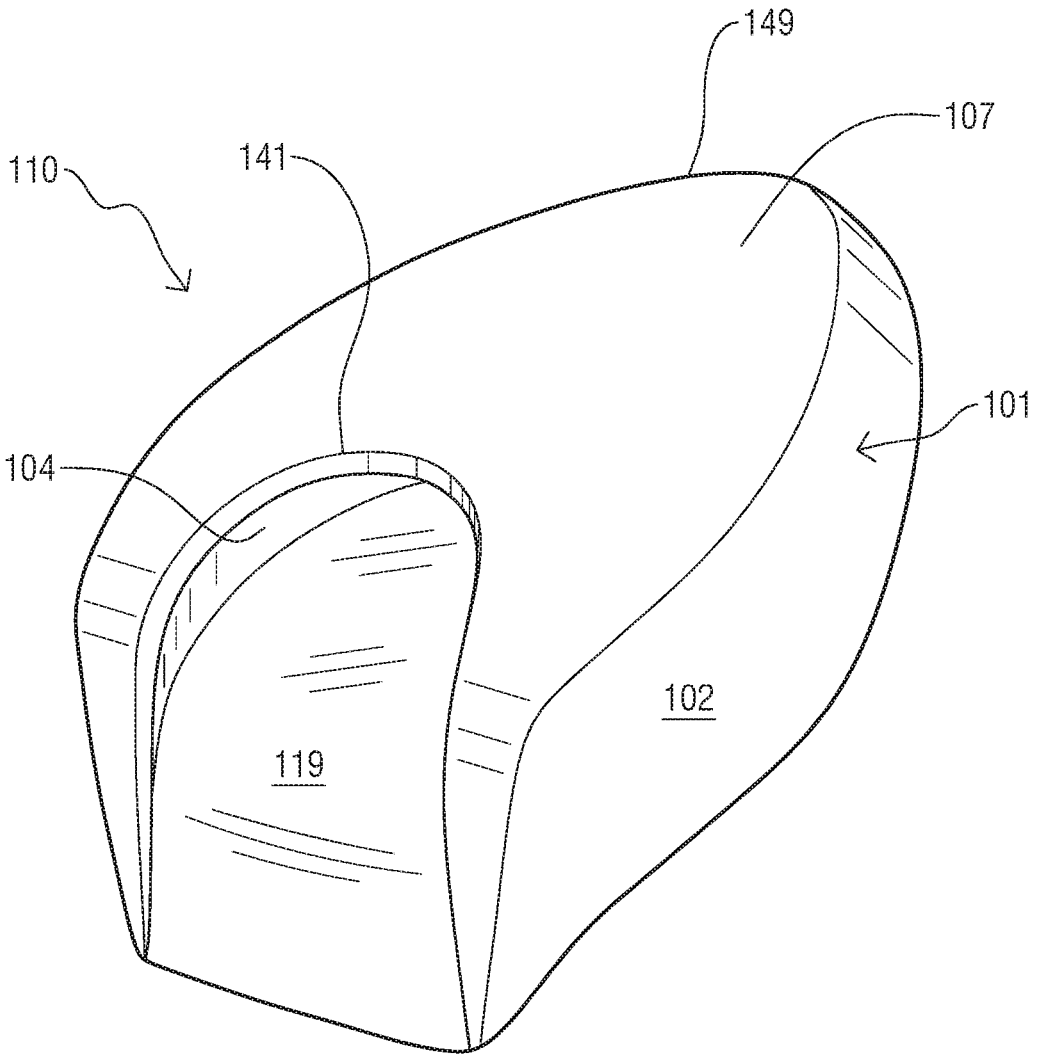
FIG. 25 is a perspective back view of the bottom of the construction unit of the present invention with a thick peripheral wall, which causes the roof of the body of the construction unit to be reduced in area and causes the bottom boundary to be increased in area.

The peripheral wall 101 extends downwardly from the intersectional area 114 (FIG. 5) to terminate in a bottom boundary 107. The bottom boundary 107 extends from a bottom boundary outer edge 149 (FIGS. 15, 25, 27) to a bottom boundary inner edge 141 (FIGS. 15, 25). The bottom boundary 107 meets the inner wall 104 at corner 120 (FIG. 15), which in some aspects of the invention, such as in FIG. 15, corresponds to the bottom boundary inner edge 120. In FIG. 15, corner 120 is a substantially right-angle corner. In other aspects of the invention, the inner wall 104 may be curved and not form a right angle. In other aspects (FIG. 22) of the invention, the inner wall 104 may join the bottom boundary 107 at an inner location. The bottom boundary 107 is disposed at a lower third level, and which is generally at least partially planar. Bottom boundary 107 may be the walking surface or may be covered with a tread, outsole, or encasement 180 (FIGS. 20-21) based on considerations of style and functionality. Bottom boundary 107 may optionally be configured with texturing or grooves 171 (FIG. 18) to increase traction.

The upraised area 105 is an open space that serves as a decoration-receiving recess. The upraised area 105 has a top (as oriented as in FIG. 5 and as oriented when incorporated into a shoe) defined by the body inner roof surface 119 (FIG. 4) of the upper body 111 and has sides defined by the inner wall surface 104 of the peripheral wall 101. There is a gap between the right and left peripheral back margins 109 of the peripheral wall 101 with nothing bridging the gap, so that the back portion of the weight-bearing peripheral wall 101 is open.

The body inner roof surface 119 is disposed at the middle second level. The second level is above the third level, which thus elevates the top of the upraised area 105 above the walking surface and thus minimizes or eliminates damage to and sullying of the decorative component 150 carried within the upraised area 105. The height of the peripheral wall 101 is generally the distance between the second and third levels, while the height of the upper body 111 is generally the distance between the first and second levels.

The height of the peripheral wall 101 may vary based on the height of the decorative component 150 and on stylistic and functional requirements. The height of the peripheral wall 101 is greater than the height of the decorative component 150, so that the decorative component 150 is elevated above the ground.

Figure 27:
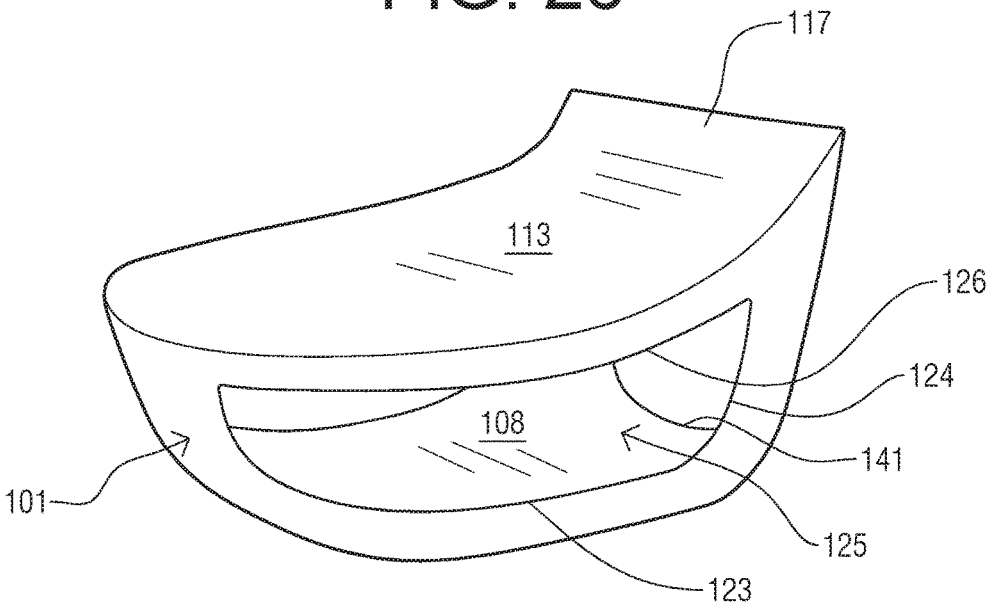
FIG. 27 is a perspective side view of the top of the construction unit of the present invention with a thicker peripheral wall and with a large cutout in the peripheral wall.

Because the back of the weight-bearing peripheral wall 101 is open, the decorative component 150 can be fixedly attached to the body inner roof surface 119 and can run continuously out the back of the upraised area 105 between the right and left peripheral back margins 109 (FIGS. 4-5). In one aspect, the decorative component 150 is further disposed on, and fixedly attached to, the inner surface of the peripheral wall 101. In another aspect, the decorative component is also disposed on, and fixedly attached to, the bottom surface of the arch section 55 of the shoe and/or the inside breast surface 63 of the heel 53. The decorative component 150 comprises one or more of a toe decorative section 155 (FIG. 9) attached to a toe decoration-receiving surface (body inner roof surface 119), an arch decorative section 140 (FIG. 9) attached to an arch decoration-receiving surface (arch surface 54, FIG. 1), a heel decorative section 145 (FIG. 9) attached to a heel decoration-receiving surface, and a body inner floor decorative section attached to a body inner floor surface (grotto floor) 108 (FIG. 27). In one aspect of the invention, the decorative component 150 also is disposed on, and fixedly attached to, all or at least a portion of the inner wall surface 104 of the peripheral wall 101 that partially defines the upraised area 105.

The decorative component 150 has a height less than the height that the inner wall surface 104 extends below the body inner roof surface 119, which prevents scratching or soiling of the decorative component 150. The decorative component 150 may be substantially flat (such as a brightly colored sheet or film of iridescent material), may be thin (such as ostrich skin or alligator skin), may have a medium thickness (such as the half pearls of FIG. 9), or may have a taller height up to a height just less than the height of the recess (such as multi-jeweled chains extending from the body inner roof surface 119 and having a height just less than the height of the inner wall surface 104). For example, the decorative components may comprise crystals, rhinestones, ceramic beads or particles, glass beads or particles, porcelain, textiles, sequins, mirrors, links of chains, metal electroplating (gold, silver, copper, and the like), fur, precious stones (diamonds, emeralds, rubies, and the like, semiprecious stones, exotic skins, leathers including quilted or printed leathers, and other two-dimensional and three-dimensional synthetic or natural materials. The decorative component 150 may be individual, linked, or composite elements fixedly attached to the decoration-receiving surface, may be a sheet of material (substrate 177 of FIG. 2*a*) with individual, linked, or composite elements fixedly attached to the substrate 177 that is then fixedly attached to the decoration-receiving surface, may be a sheet of material with an attractive pattern or texture, or may be a combination of individual, linked, or composite elements and a sheet of material with an attractive pattern or texture. Individual elements of the decorative component 150 may be set in individual settings or may be set in channels. The elements of the decorative component 150 may be of a consistent size or may vary in size. In an exemplary aspect, shown in FIG. 2, the decorative component 150 comprises a substrate 177 embedded with or otherwise carrying rhinestones. In an exemplary aspect shown in FIG. 9, the decorative component 150 comprises multiple half spheres, such as half pearls. In the exemplary aspect of FIGS. 12-13, the decorative component 150 comprises individual medallions, nail heads, or studs fixedly adhered to the decoration-receiving surface.

In one aspect of the invention, the height of the peripheral wall 101 (around upraised area 105) of the construction unit 110 has a height that is greater than the height of the upper body in of the construction unit 110. This aspect can be seen in FIGS. 3-5 in which the inner wall surface 104 of wall 109 has a height that is greater than the height of the back surface 116 of the body 111. In this aspect, the distance between the first plane and second plane is smaller than the distance between the second and third planes.

In another aspect of the invention, the height of the peripheral wall 101 (around upraised area 105) of the construction unit 110 has a height that is less than the height of the body in of the construction unit 110. This aspect can be seen in FIGS. 7-8 in which the inner wall surface 104 has a height that is much less than the height of the body back surface 116. In this aspect, the distance between the first plane and second plane is larger than the distance between the second and third planes.

In an additional aspect of the invention, the height of the peripheral wall 101 (around upraised area 105) of the construction unit 110 has a height that is approximately equal to the height of the body 111. This aspect can be seen in FIG. 10, in which the inner wall surface 104 is approximately the same height as the body 111.

The body top surface 113 of the toe construction unit 110 is shaped, sized, and configured to be fixedly attached to the bottom surface of the toe section 60 of the upper 51. Thus, the body top surface 113 of the upper body 111 will, in general, correspond to the general shape of the toe section 60 (such as generally V-shaped for pointed-toed shoes or generally U-shaped for rounded-toed shoes). And the outer body surface and peripheral wall 101 may often follow the V- or U-shape of the toe but may be varied based on design and functional considerations.

The attachment of the construction unit 110 to the bottom of the toe section may be by means of a glue, adhesive, or other bonding agent; may be by mechanical means such as screws, monofilament 159 (FIG. 17) tying the two together, or other mechanical devices; or may be by the use of both a bonding agent and one or more mechanical devices. The monofilament 159 may be disposed within a channel 157, 158 in either or both of the construction unit 110 and the upper portion and may be used to sew or bind them together.

In one aspect, as seen in FIG. 3, the rear portion of the upper body in is configured with a wedge 117. The wedge 117 extends upwardly at the back of the body top surface 113, which follows the line of the shoe upper between the toe section and the arch section to form an incline or ramp. The wedge 117 tapers rearwardly to an edge 122. For some styles of shoes, the inclusion of the wedge 117 enhances the attachment of the body in to the upper 51 (or to a midsole disposed between the upper 51 and the wedge 117) and increases the robustness of the upper body in.

Also seen in FIG. 3, the body outer surface 112 extends vertically downwardly from the periphery of the body top surface 113. The peripheral wall outer surface 102 also extends vertically downwardly and is generally aligned with the body outer surface 112. This alignment creates a smooth façade, which may be covered with a covering 62 (FIG. 6) or may be left exposed based substantially on aesthetic considerations. Similarly, as seen in FIG. 5, the body back surface 116 extends vertically downwardly from the back edge 122 (FIG. 3) of the body top surface 113 and/or the back wedge 117. And the peripheral wall back surface 106 extends vertically downwardly and is generally aligned with the body back surface 116 to create a smooth façade, which may be covered by a footwear material or may remain uncovered.

FIG. 6 illustrates a partially assembled embellished shoe 100, which shows a step in an exemplary assembly. In manufacturing the embellished shoe 100, the body top surface 113 of the body 111 is fixedly attached to the bottom surface of the toe section 60 of the shoe upper. Therefore, preferably, the outer perimeter of the upper body 111 and the outer perimeter of the weight-bearing peripheral wall 101 conform to the shape of the outer perimeter of the upper toe section 60 to produce a smooth façade. However, based on design decisions or aesthetic considerations, the creation of a smooth façade is not necessary to the invention.

In all embodiments, the construction unit 110 is fixedly attached to the upper 51 (either directly or with intermediary layers). This may be accomplished by any means known in the art, such as by bonding agents or adhesive attachment, by the use of mechanical fasteners such as nails or screws or microfibers, or by a combination of adhesive attachment and mechanical fasteners.

In an aspect of the invention, as seen in FIG. 6, the perimeter of the body 111 and of the weight-bearing peripheral wall 101 are covered with a covering 62, which may match, coordinate with, or contrast with the material forming the shoe upper 51 based on aesthetic considerations. The covering 62 may be selected by the manufacturer to veneer the body outer surface 112 and wall outer surface 102 with ornamental material that may match with, coordinate with, or contrast with the decorative component 150 and/or the material forming the shoe upper 51.

In another aspect of the invention, the perimeter of the body 111 and of the weight-bearing peripheral wall 101 remain uncovered with the material forming the construction unit exposed.

In a further aspect of the invention, the bottom boundary 107 may be textured or scored to provide additional traction.

In an aspect of the invention shown in FIG. 9, an additional outsole portion 138 is fixedly attached to the bottom surface or bottom boundary 107 (which may be textured, scored, or smooth) of the weight-bearing peripheral wall 101. The outsole portion 138 may form a tread. The outsole portion 138 may be formed of a rubber or rubber-like material, may be formed of a slip-resistant material to add grip strength, or may be formed of other conventional tread materials.

FIGS. 12-13 illustrate the second embodiment in which an open-back toe construction unit 110 is disposed on the toe of a flat shoe and in which a second construction unit, a closed construction unit 160, is disposed on the heel of a flat shoe. The closed construction unit 160 comprises at least an arcuate wall 163 and a transverse wall 166. In an aspect of the invention, the arcuate wall 163 and the transverse wall 166 are fixedly attached to the body 111 that is then attached to the upper 51 or to the midsole disposed below the upper 51. In this aspect, an upraised region 165 is an open space defined by the inner curved sides of the arcuate wall 163, the inner side of the transverse wall 166, and an upraised region top surface.

The closed upraised region 165 is configured to receive the decorative section, as described above. Though the closed heel construction unit 160 is illustrated as a short heel (around three-fourth inches in height), the closed construction unit may be implemented with much taller walls 163, 166. Additionally, though in FIGS. 12-13, the closed construction unit 160 is disposed on the heel section of the shoe and the open-back construction unit 110 is disposed on the toe section of the shoe, two open-back construction units 110 may be disposed on the toe and on the heel sections, or two closed construction units 160 may be disposed on the toe and heel sections, or the open-back construction unit 110 may be disposed on the heel section and the closed construction unit 160 may be disposed on the toe section.

In the second embodiment illustrated in FIGS. 12-13, both the body 111 and the weight-bearing peripheral wall 101 of the toe construction unit 110 are segmented to enhance the flexibility. Though in the first embodiment the weight-bearing peripheral wall 101 and the body 111 are preferably formed unitarily by molding, in this embodiment the weight-bearing peripheral wall 101 and the body 111 are formed in segmented members 121. Each segmented member 121 includes a segment of the wall 101 and a segment of the body 111. Adjacent segmented members 121 are separated by a horizontal gap 129 between the wall bottom surfaces of adjacent segmented members 121, a vertical gap 127 along the inner wall surface 104 (FIG. 13) between adjacent segmented members 121, and a horizontal gap 128 between the upper body 111 of adjacent segmented members 121.

Having two or more segmented members 121 may provide an advantage to some shoes in that the segments increase the flex or bend of the portion of the sole to which they are applied. However, the segmented members 121 may be utilized by shoe designers for aesthetic reasons on other shoes that do not need the flexing functionality.

FIG. 15 illustrates an aspect in which a sloped or inclined back wedge 117 at the rear of the construction unit 110 tapers to a very thin back edge 122. This allows a very smooth transition between the construction unit 110 and the arch, which may have both functional and aesthetic advantages.

Figure 16:
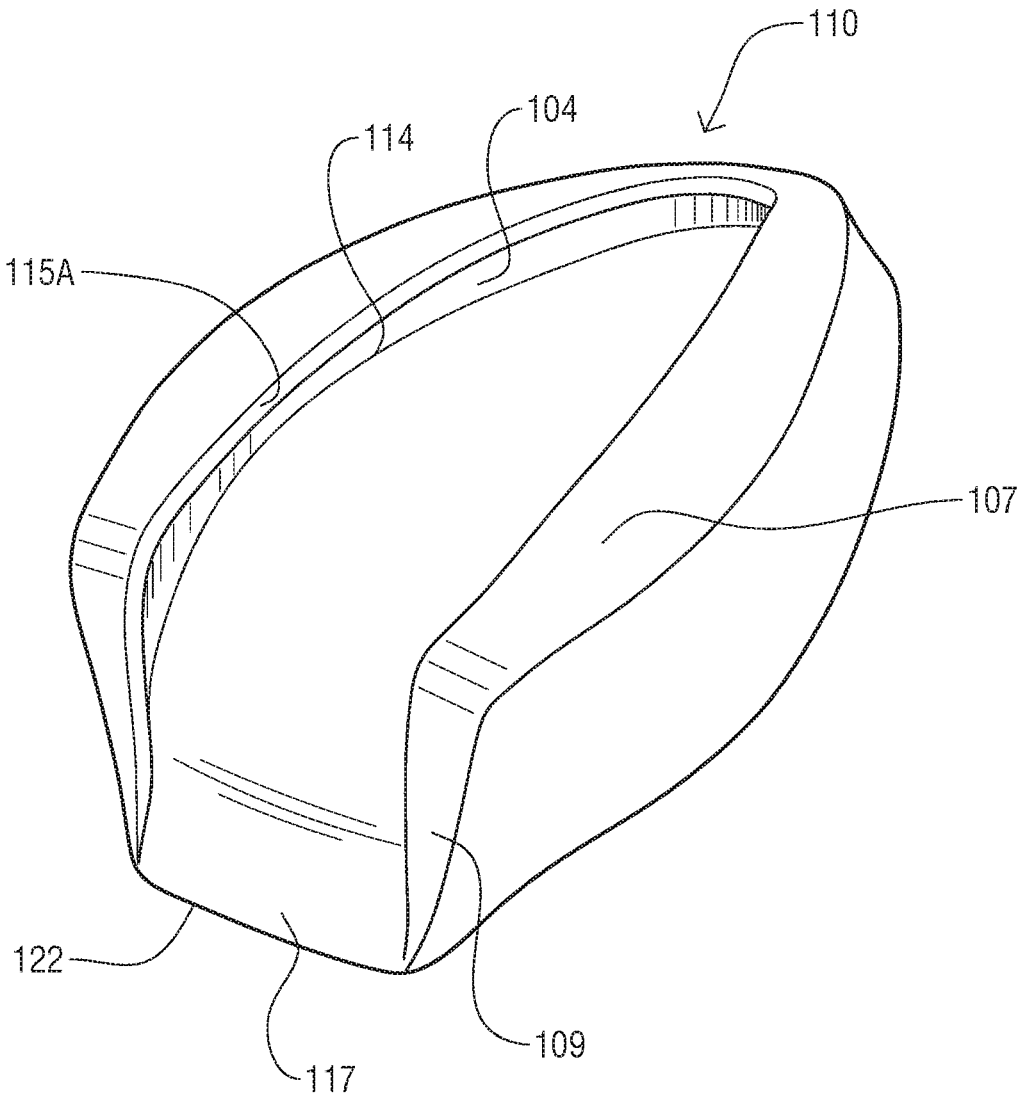
FIG. 16 is a perspective view of the bottom of the construction unit of the present invention with a peripheral wall terminating in a tapering right and left back wall margin.
Figure 17:
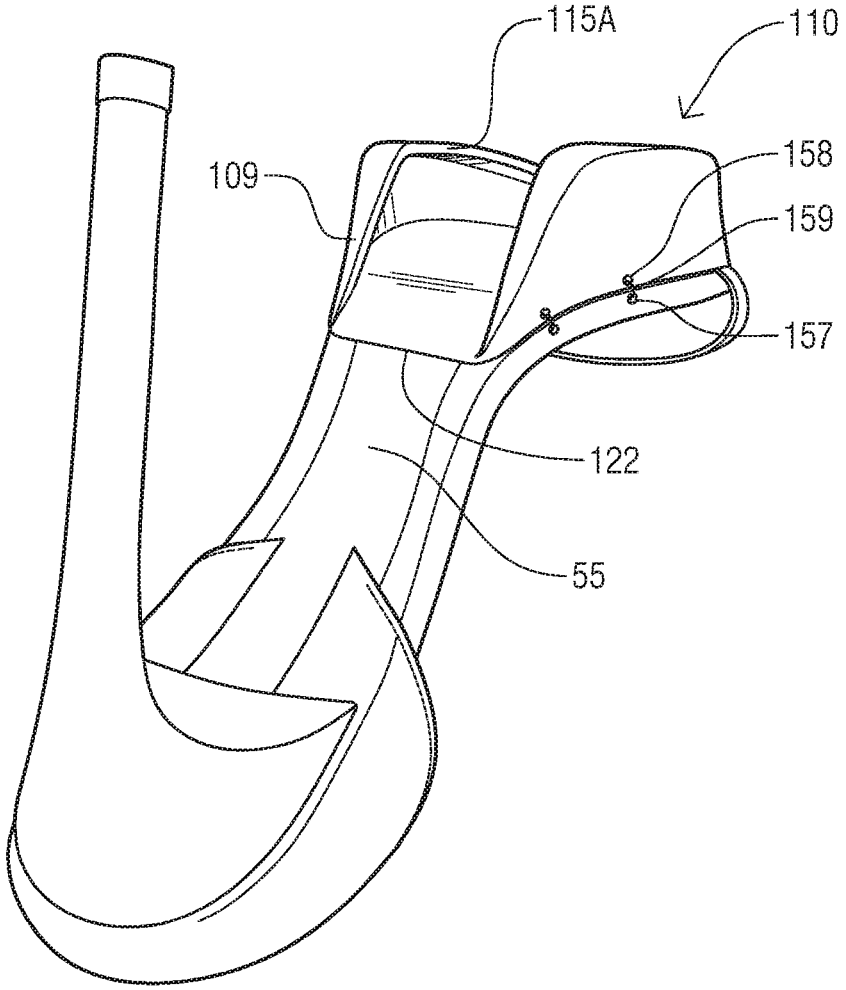
FIG. 17 is a perspective view of the bottom of a shoe of the present invention under construction that incorporates the construction unit with a peripheral wall terminating in a tapering right and left back wall margin.

FIGS. 15-17 illustrate an aspect in which the center of the bottom boundary 107 has a greater thickness than the front or the rear of the bottom boundary 107, which may be advantageous in providing traction and walking stability. The right and left peripheral back margins 109 may be somewhat thinner in thickness than the middle of the bottom boundary 107 and may be generally uniform in thickness, as in FIG. 15, or may taper to a narrow V-shape, as illustrated in FIGS. 16-17. The narrow V-shape may allow easier viewing of the interior decorative component 150.

FIG. 15 also illustrates a weight-bearing peripheral wall 101 that has a narrow width from wall outer edge 149 to wall inner edge 141. The inner wall is substantially vertical. This is in contrast to the aspect show in FIG. 25 in which the peripheral wall 101 has a wide width from wall outer edge 149 to wall inner edge 141. The inner wall is inset (such as to form a smooth concavity). Thus, the inner and outer surfaces of the wall 101 may be generally parallel (as in FIG. 15) or may not be parallel (as in FIG. 25). And the width of the wall may be thinner or thicker. When the wall width is thin, a larger surface area of the body inner roof surface 119 is available for receiving decorative elements. When the wall is thicker, it may provide more traction, but reduces the area of the body inner roof surface 119 available for receiving decorative elements.

Figure 18:
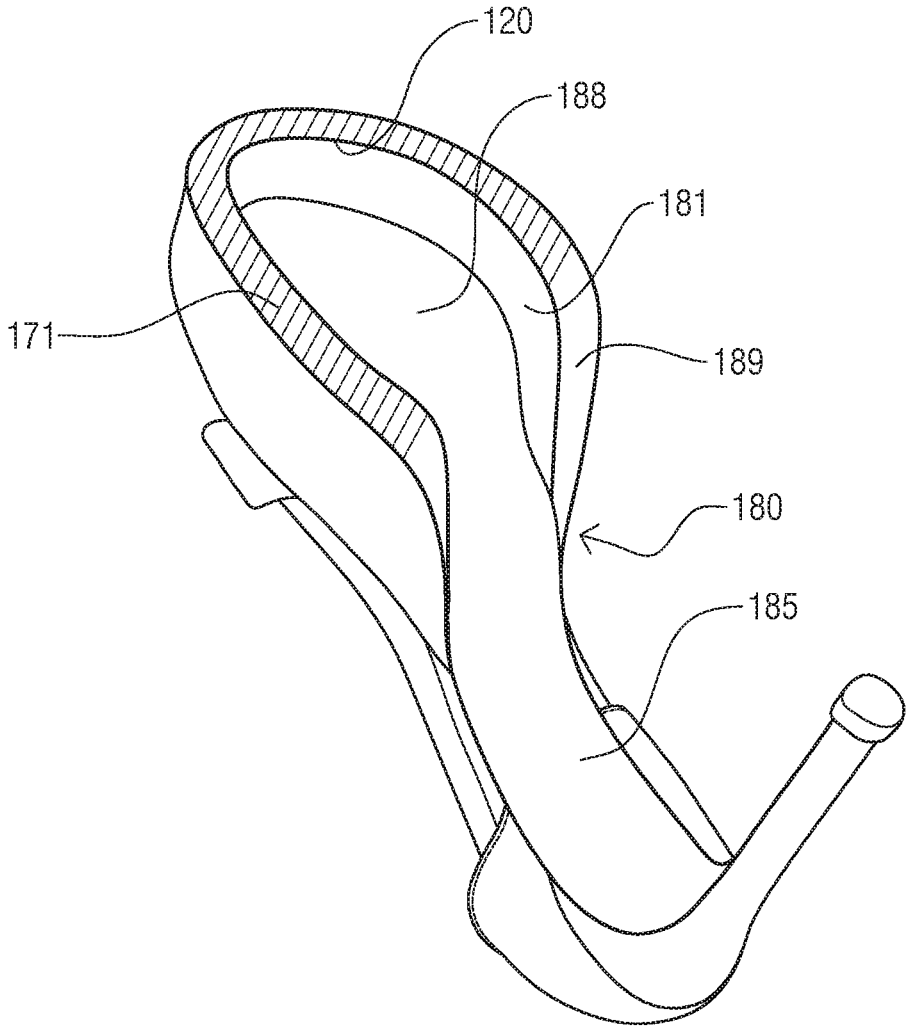
FIG. 18 is a perspective bottom view of a shoe of the present invention incorporating the construction unit having a peripheral wall terminating in a tapering right and left back wall margin and having an encasement disposed over the body inner roof surface, the inner surface of the peripheral wall, the arch, the inner heel, and the bottom boundary.
Figure 19:
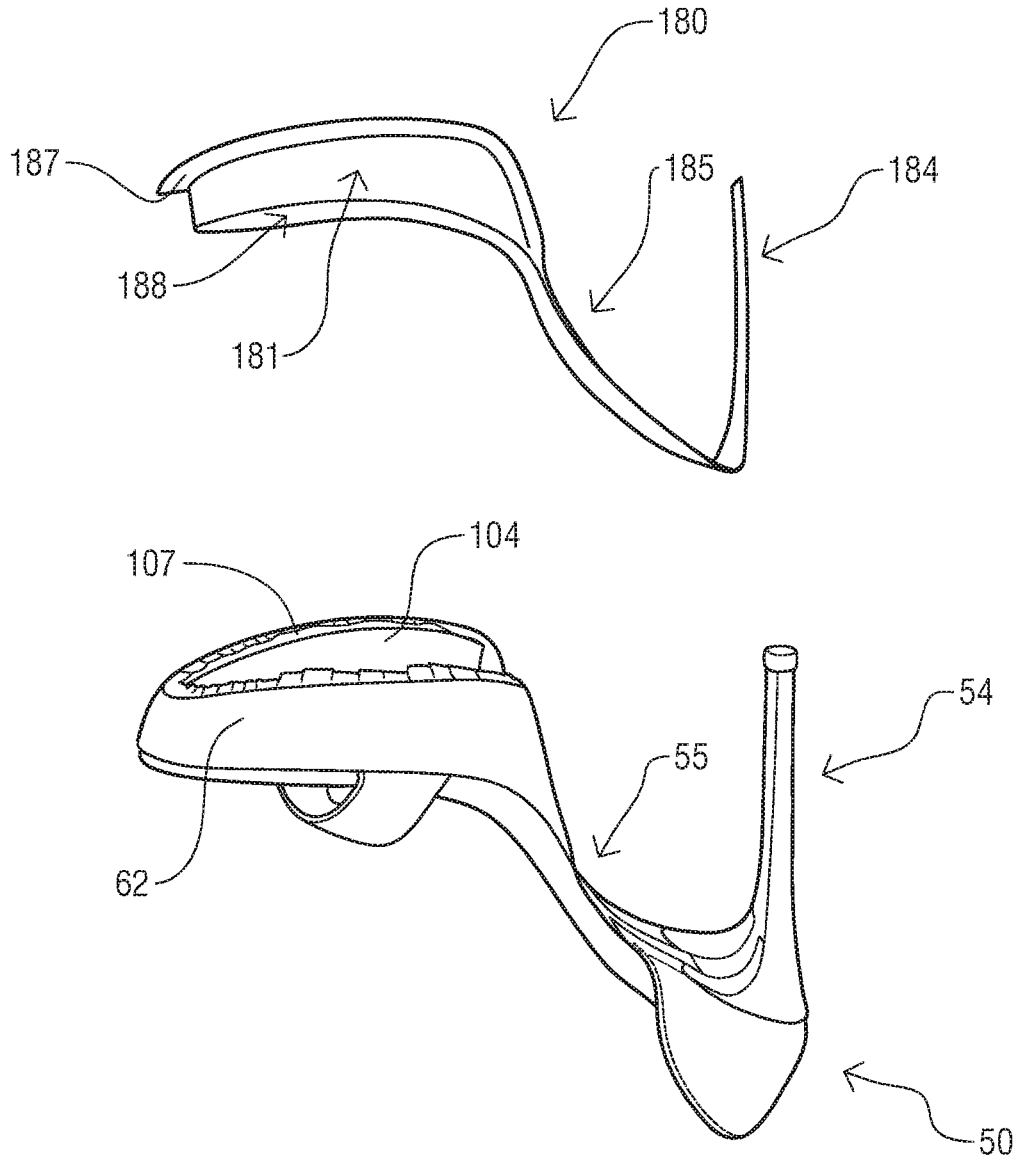
FIG. 19 is an expanded side perspective view of the construction of a shoe of the present invention incorporating the construction unit and of an encasement corresponding to the shape of the bottom of the shoe of the present invention.

FIG. 17 illustrates the very smooth transition between the construction unit 110 and the arch area 55 that can be achieved when the back of the construction unit 110 is tapered into the wedge 117 ending at edge 122, as illustrated in FIGS. 15-18. The shoe under construction in FIG. 17 is shown before an outer covering (such as leather, imitation leather, or cloth) is disposed along the outer side and front surfaces of the construction unit 110 and the toe portion of the midsole to provide a consistent, elegant look. Additionally, to finish the manufacture of the shoe in FIG. 17, an encasement 180 (FIG. 19) may be applied to any or all of the upraised area 105, the wedge portion 117, and the arch portion 55; and then a decorative component 150 may be applied to the outside of the encasement 180 or may be integrated into the encasement 180. FIG. 18 shows a shoe with the encasement 180 applied, but before the decorative component 150 is fixedly attached.

FIGS. 18-22 illustrate a third embodiment of the invention that further discloses an encasement 180 that conforms to the bottom portion of the shoe to give a polished, refined look. The use of the encasement 180 enables the multiple portions of the construction unit and shoe bottom portions to be smoothly covered and enhanced, which is comparable to the finished look achieved by using material to cover the parts of the upper to give a smooth, finished look. The encasement 180 may coordinate or contrast with the upper, based substantially on fashion and aesthetic concerns.

The encasement 180 comprises at least a recess roof encasing portion 188 (FIGS. 20, 23), and preferably also comprises one or more of a recess wall encasing portion 181, an arch encasing portion 185, an inner heel encasing portion 184, and an underside encasing portion 189. The recess roof encasing portion 188 is sized and configured to fit over and, in the finished shoe, to be fixedly attached to the body inner roof surface 119. The recess wall encasing portion 181 is sized and configured to fit over and, in the finished shoe, configured to have its inward-facing surface fixedly attached to the outer surface of the peripheral inner wall 104. The inner heel encasing portion 184 is sized and configured to fit over and, in the finished shoe, configured to have its inward-facing surface fixedly attached to the outer surface of the inner heel breast 63. The arch encasing portion 185 is sized and configured to fit over and, in the finished shoe, configured to have its inward-facing surface fixedly attached to the outer surface of the bottom or arch 55. The underside encasing portion 189 is sized and configured to fit over and, in the finished shoe, configured to have its inward-facing surface fixedly attached to the surface of the bottom boundary 107. Specifically, the inner side 187 (FIG. 19) of underside encasing portion 189 is fixedly attached to the outside of the bottom boundary 107. As shown, the underside encasing portion 189 may be configured with irregularities 171 (such as grooves or texturing) to increase traction and facilitate walking stability. In an aspect, the underside encasing portion 189 may be configured with an inset that covers a portion of the bottom boundary 107. For example, if the encasement 180 is formed of a precious metal, a thermoplastic insert within the underside encasing portion 189 may be included to slightly elevate the precious metal to avoid wear. The insert may be replaceable. In an aspect the underside encasing portion 189 may comprise multiple layers with an inner decorative layer and an outer wearable layer, such as a thin transparent synthetic stratum.

The encasement 180 may be formed in parts and fixedly joined together or may be formed unitarily, such as by molding. The encasement 180 may be a thin skin to enhance the finished look or may be thicker to provide cushioning and/or to facilitate attachment of the decorative component 150. In one aspect the encasement 180 is formed of thermoplastic. In another aspect the encasement 180 is formed of metal.

Figure 20:
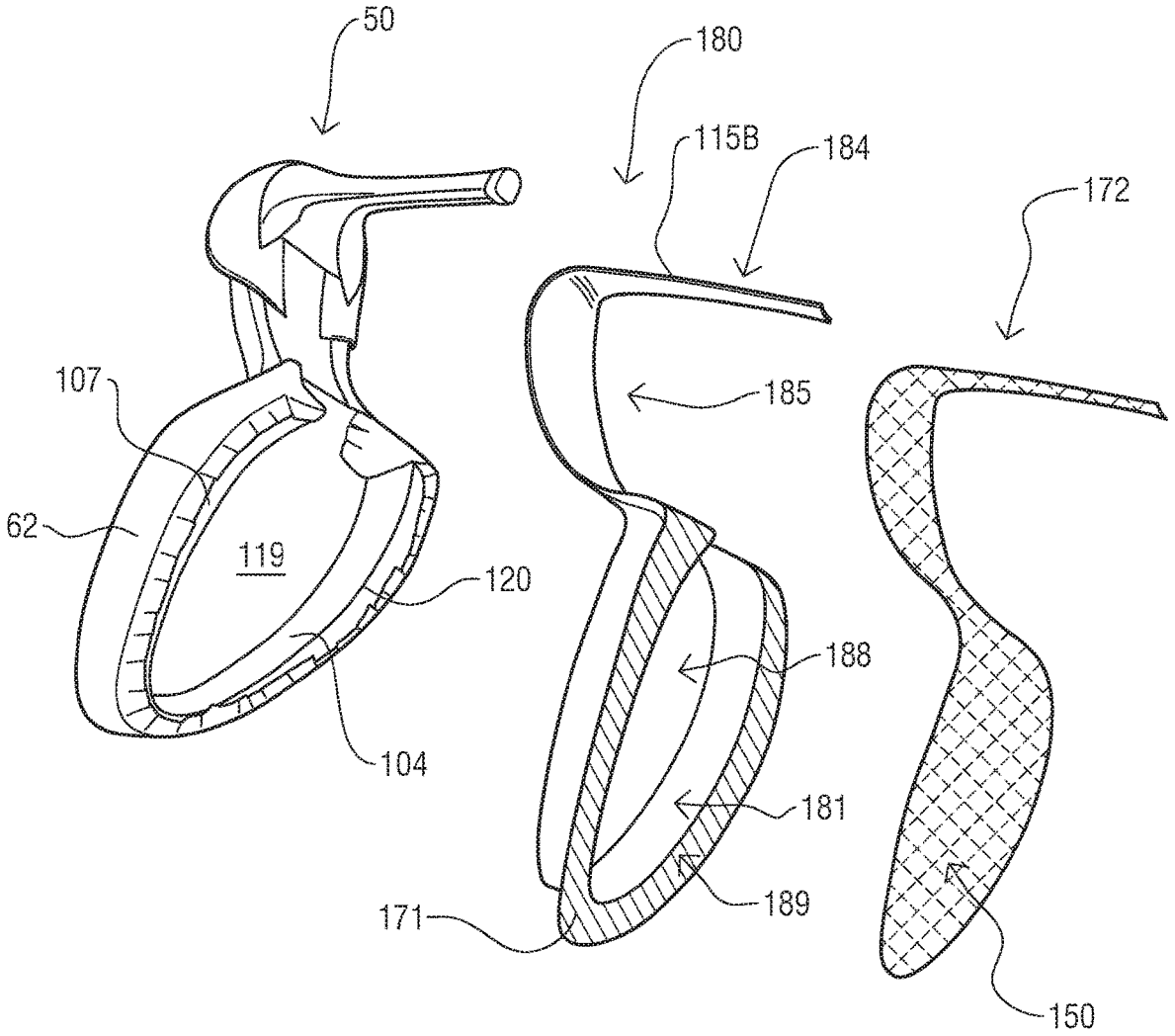
FIG. 20 is an expanded side perspective view of the construction of a shoe of the present invention incorporating the construction unit, an encasement corresponding to the shape of the bottom of the shoe, and of an inlay corresponding to the shape of the body inner roof surface, the arch surface, and the inner heel surface.
Figure 21:
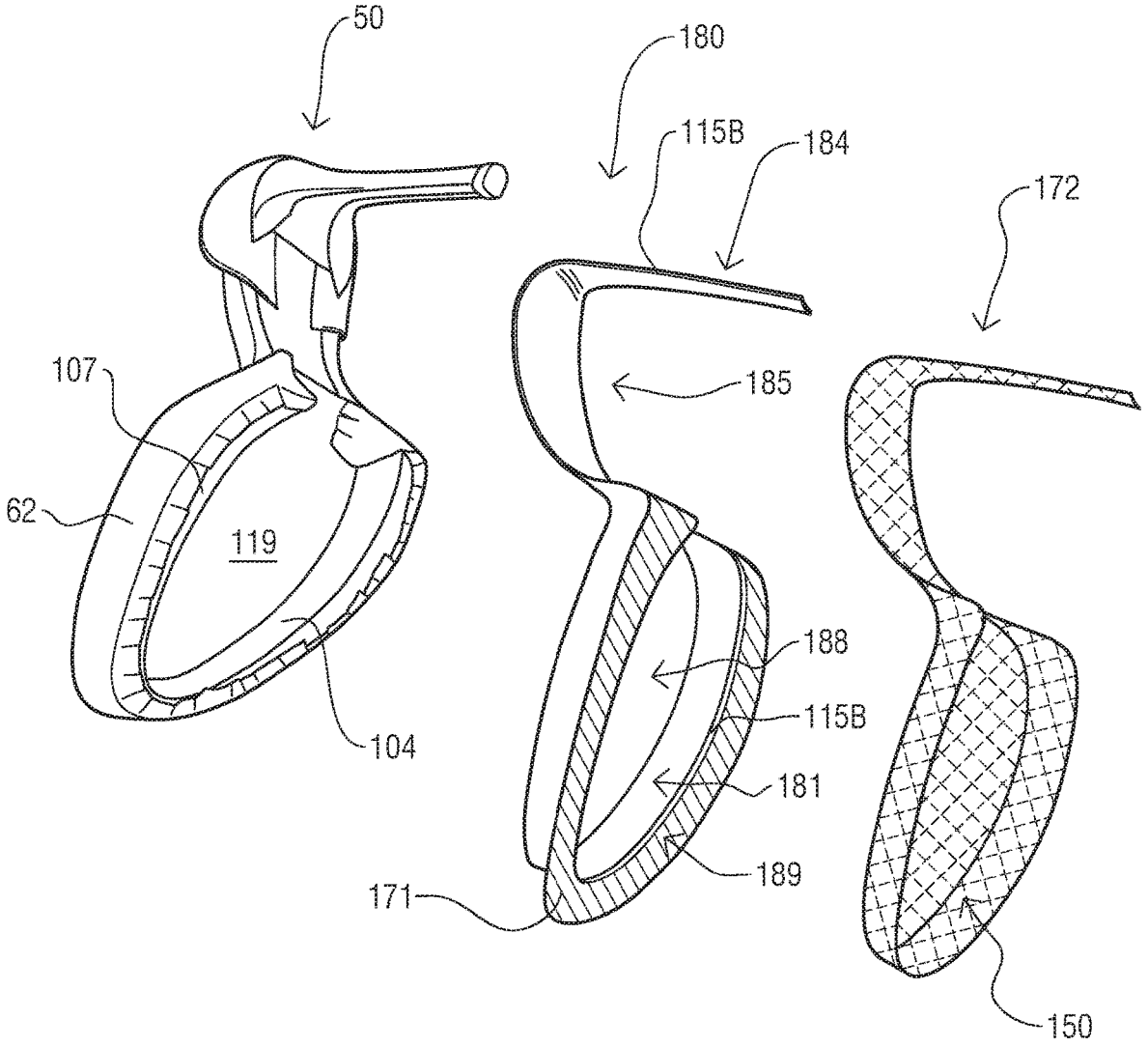
FIG. 21 is an expanded side perspective view of the construction of a shoe incorporating the construction unit, an encasement corresponding to the shape of the bottom of the shoe, and of an inlay corresponding to the shape of the body inner roof surface, the inner surface of the peripheral wall, the arch surface, and the inner heel surface.
Figure 23:
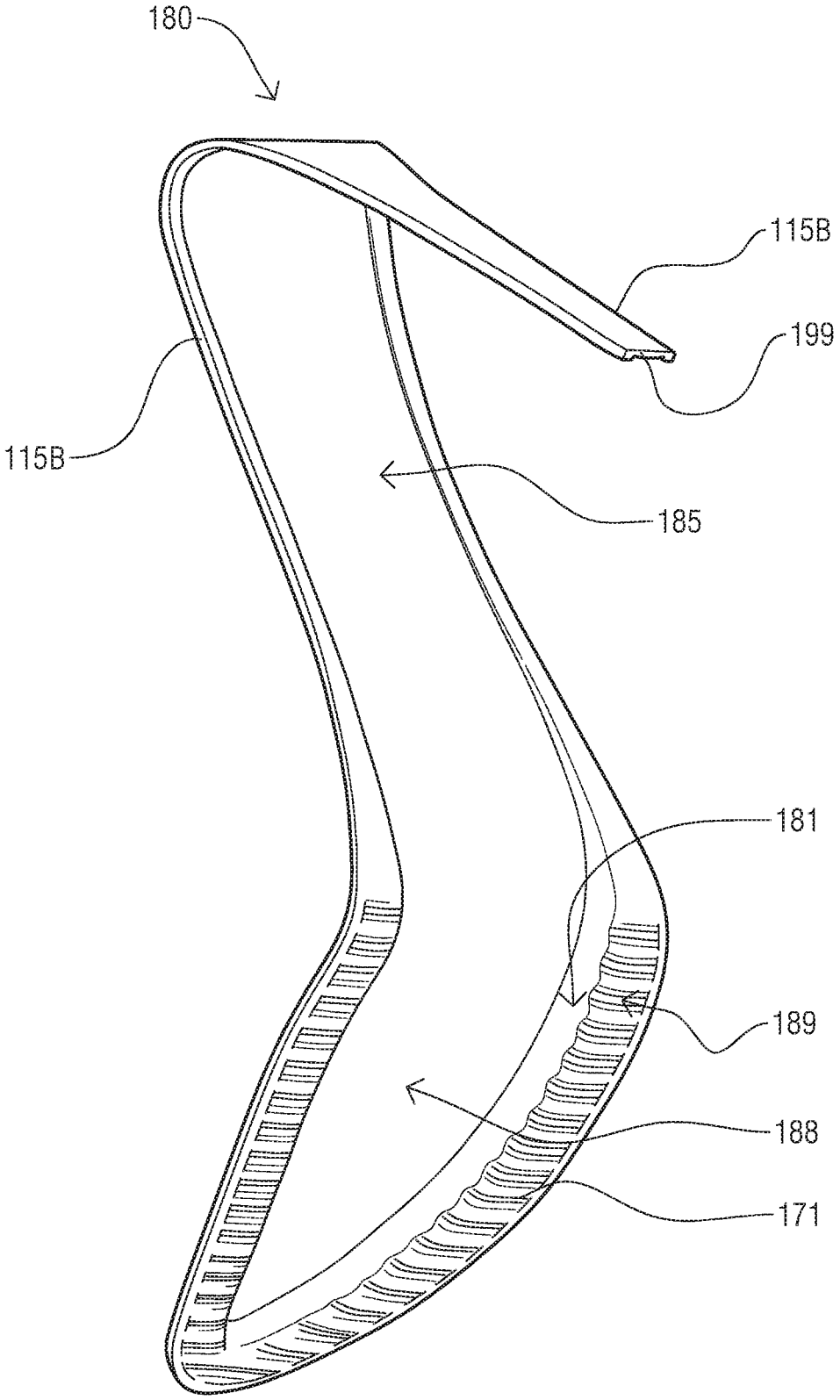
FIG. 23 is a bottom perspective view of an encasement of the present invention.

In the finished shoe, the decorative component 150 may be fixedly attached to, or formed integrally with, any or all portions of the encasement 180. In one aspect, the decorative component 150 is carried by a substrate 177 (FIG. 2A) that may be formed by an inlay 172 that is fixedly attached to the encasement 180. In one aspect, the inlay 172 may be larger to substantially cover the entire area of the upraised area 105, arch bottom surface, and heel inner surface, as seen in FIG. 21. In another aspect, the inlay 172 may only cover a portion of the upraised area 105. In another aspect, the inlay may cover only the body inner roof surface 119 or, as seen in FIG. 23, the inlay may cover only the recess roof encasing portion 188 that covers the body inner roof surface 119. In another aspect, as seen in FIG. 20, the inlay 172 may cover the body inner roof surface 119 (or the recess roof encasing portion 188 that covers the body inner roof surface 119), the arch bottom surface, and heel inner surface. The inlay 172 corresponds generally in shape to the portions to be covered. In one aspect inlay 172 may be formed of a flexible material that has a degree of elasticity or adjustability to enable to inlay 172 to be applied smoothly.

Figure 22:
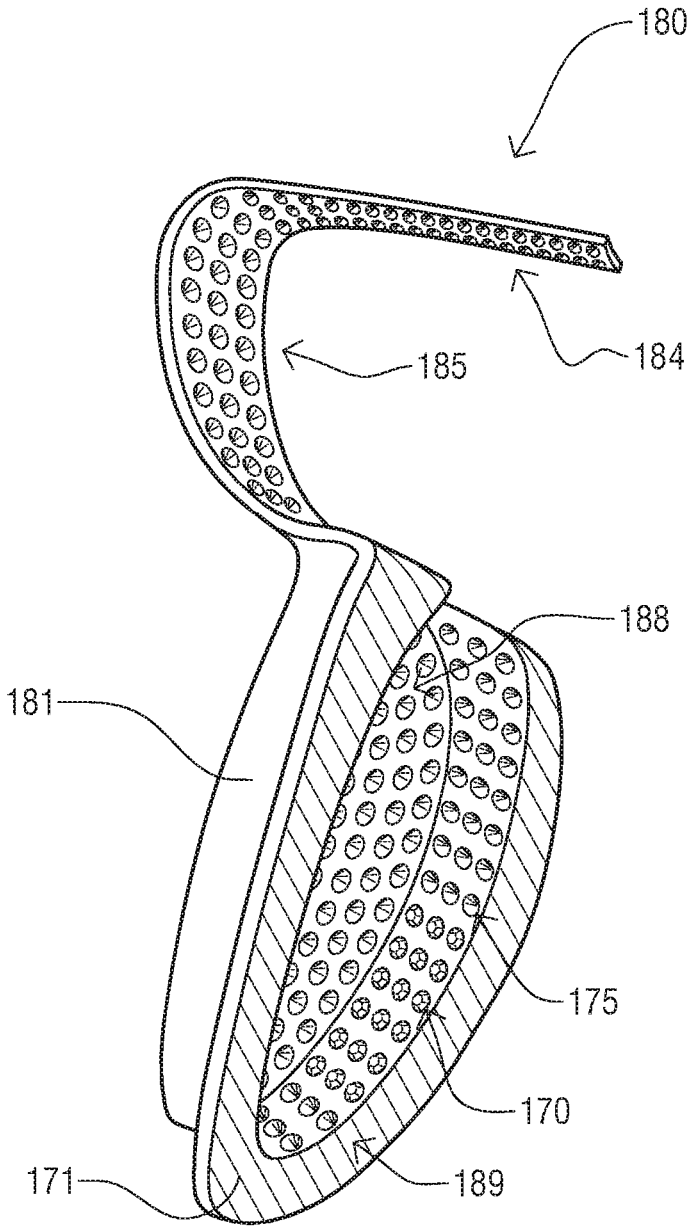
FIG. 22 is a bottom perspective view of an encasement of the present invention configured to receive decorative elements with some decorative elements installed.

Though FIG. 22 shows a single type of decorative component fixedly attached to the recess roof encasing portion 188, the recess wall encasing portion 181, the arch encasing portion 185, and the inner heel encasing portion 184, there is no requirement that a single type of decorative component be used. As dictated by fashion, aesthetics, and functionality, multiple types of decorative components may be used. For example, if sharp spikes are attached to the recess roof encasing portion 188, metal studs may be attached to the other portions of the outer portion of the encasement 180. Or in a second example, rhinestones may be attached to the recess roof encasing portion 188, the arch encasing portion 185, and the inner heel encasing portion 184 with sequins attached to the recess wall encasing portion 181. The thickness of the encasement 180 may be based on the type of decorative component 150 that will be attached, as well as aesthetic and functional concerns.

FIG. 25 illustrates another aspect of the invention having a peripheral wall 101 with a front portion that is thicker than the front portion of the peripheral wall 101 in some other aspects, such as in the first embodiment. This thickened front portion creates an expanded front portion of the bottom boundary 107. The expanded front portion of the bottom boundary provides a variation in the design and a larger surface area for walking. The expanded bottom boundary allows the inner surface 104 of the peripheral wall 101 to be vertical or inset. The inset inner surface 104 allows for an undercut to form a cavern-like upraised area 105.

FIGS. 11, 14, 26, 27 illustrate that the peripheral wall need not be solid, but can be configured with one or more cut-throughs, holes, latticework, slits, or the like with the limitation that the peripheral wall 101 retains sufficient robustness to bear the weight of the wearer.

Figure 11:
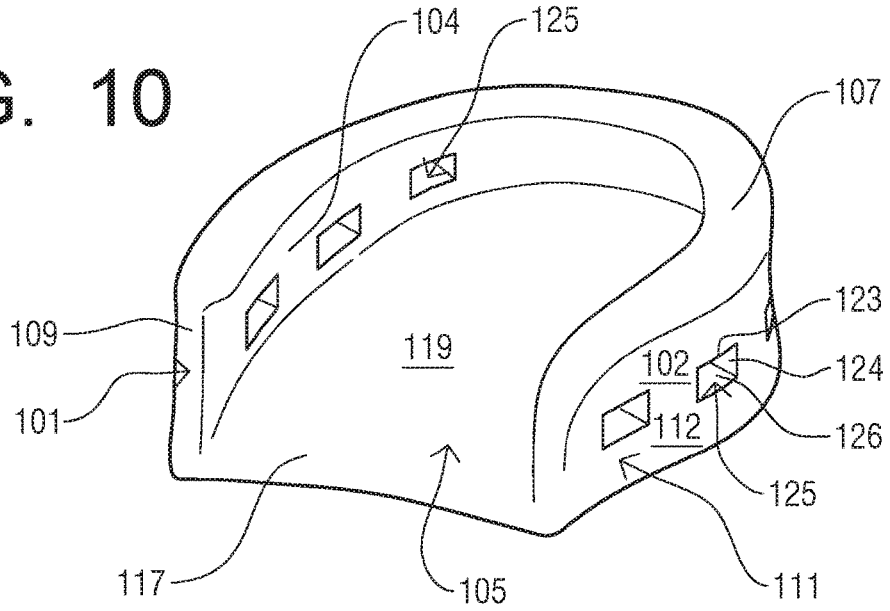
FIG. 11 is a perspective back view of the bottom of the toe construction unit shoe of the present invention with a peripheral wall that has apertures within the peripheral wall and that is thicker than the peripheral wall of FIG. 10.

FIG. 11 illustrates an aspect of the invention in which there are one or multiple openings 125 within the peripheral wall 101. Each opening is defined by a top frame 126, a bottom frame 123, and opposing side frames 124. The opening or openings 125 may serve as a type of window allowing a viewer to catch glimpses of the decorative component 150. The opening or openings 125 may also reduce the weight of the construction unit 110 but can be designed in such a manner as to minimize the reduction in strength.

Figure 14:
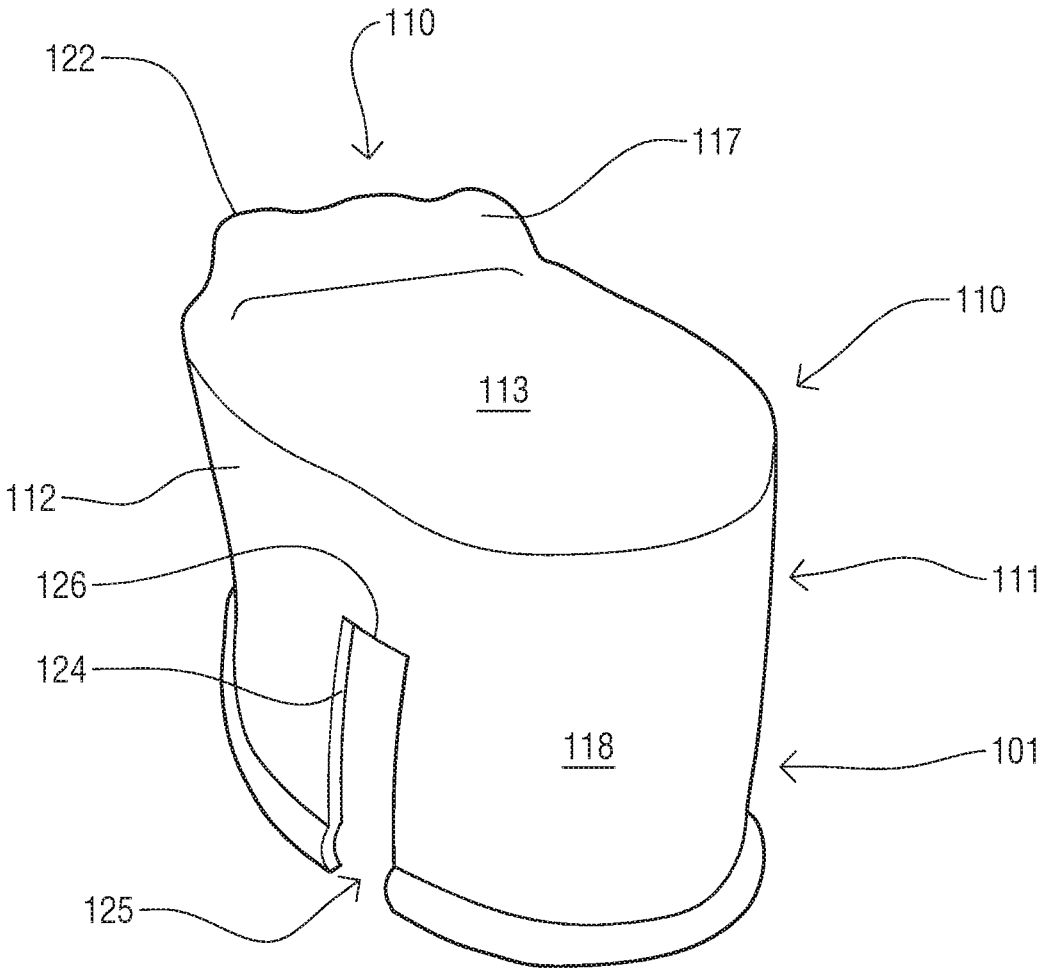
FIG. 14 is a front perspective view of the top of the toe construction unit of the present invention having a multi-segment or discontinuous peripheral wall.

FIG. 14 illustrates a slot-type opening 125 in the peripheral wall 101 that provides another means for a viewer to view the interior decorative component 150. The slot-type opening 125 is defined by side frames 124 and a top frame 126.

Figure 26:
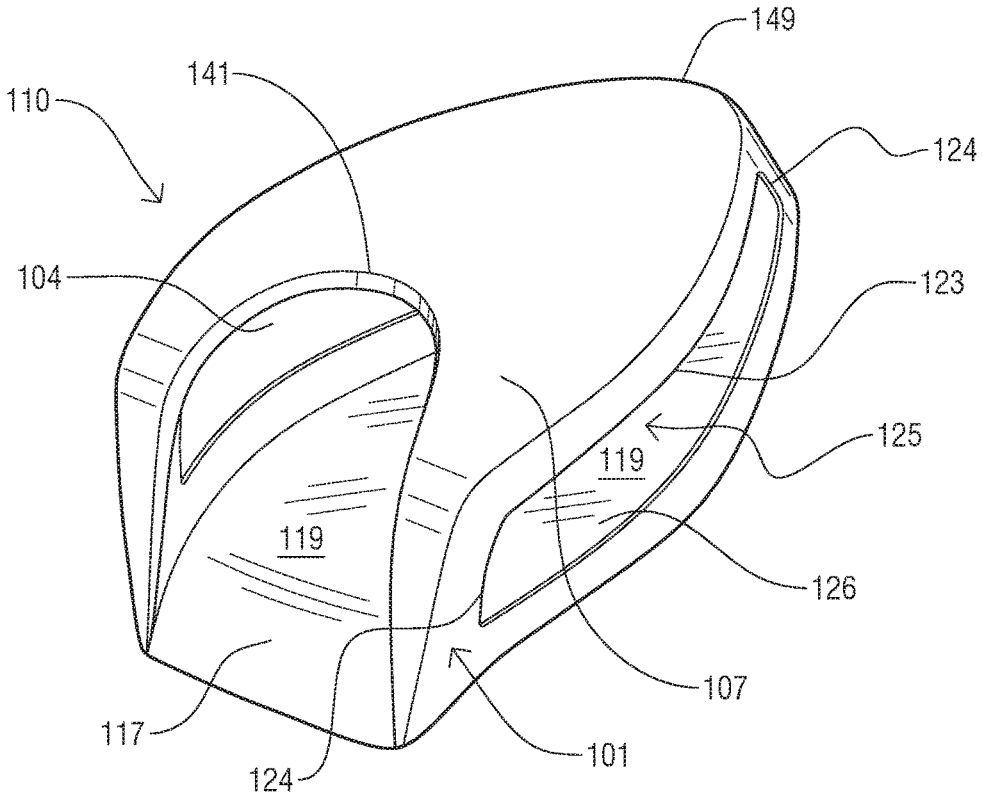
FIG. 26 is a perspective back view of the bottom of the construction unit of the present invention with a thicker peripheral wall and with a large cutout in opposing sides of the peripheral wall.

FIGS. 26-27 illustrate a fourth embodiment that includes a grotto-like cavity formed within the upraised area 105 and between the opposing side walls 101. This embodiment adds another area that can receive a decorative component 150.

In the first embodiment, there is a possibility of applying a decorative material or embellishment 150 to any or all of the body inner roof surface 119, the inner surface 104 of wall 101, the wedge 117, the back rearward surface of the unit body 111, the arch 55, and the breast 63 of the heel 53. This fourth embodiment adds another area to which a decorative component 150 may be applied, and this is the grotto floor surface 108. When the grotto-type construction unit 110 and decorative component 150 are installed into an embellished shoe too, a viewer may glimpse the decorative component disposed on the body inner roof surface when the wearer's legs are crossed, but then, when the wearer changes the angle of the foot, the viewer may glimpse the decorative component disposed on the grotto floor 108. At various angles, any decorative component disposed on the inner wall 104, the wedge 117, the back rearward surface of the unit body in, the arch 55, and the breast 63 of the heel 53 may be viewable.

The grotto is best viewable through either of the two openings 125 disposed on opposing sides of the outer wall 101. Each of the openings are defined by a top frame 126 at the level of the unit body inner roof surface 119, a bottom frame 123 at the level of the horizontally extending grotto floor 108, and a set of side frames 124. The open space of the cavity or grotto is defined by the frames of the side openings 125, a front portion and two back portions of the wall 101, and floor 108, and a roof, which is formed by the body inner roof surface 119.

The top frame 126 is disposed at the top portion of the side opening shown in FIGS. 26 and 27. The top frame 126 is aligned with the unit body inner roof surface 119 to form a smooth transition.

The bottom frame 123 is disposed at the bottom portion of the side opening. The front portion of the bottom frame 123 is at the level of and contiguous with a floor 108, which extends horizontally between the two opposing sides of a portion of the weight-bearing outer flange wall 101.

More specifically, in the aspect of the invention that is illustrated, the floor 108 extends horizontally side-to-side between the bottom frame 123 of one side opening 125 to the bottom frame 123 of the opposite side opening 125. The floor 108 extends horizontally front-to-back from the inner surface 104 (FIG. 15) of the front portion of wall 101 to the rearmost grotto floor edge, which is also the bottom boundary inner edge 141. In another aspect of the invention, the floor 108 extends horizontally side-to-side between the opposing sides of the inner surface 104 (FIG. 15) of the wall 101 and extends horizontally front-to-back from the inner surface 104 (FIG. 15) of the front portion of wall 101 to the rearmost grotto floor edge at bottom boundary inner edge 141, but is not disposed at the level of the bottom frame 123.

In the first embodiment, the body top portion surface 119 is at an upper first level, the body inner roof surface is at a second level below the first level, and the bottom boundary is at a third level adjacent to the ground and below the second level. This fourth embodiment adds a fourth level, which is the level of the grotto floor 108. The fourth level is above the third level, but below the second level. Though one or more of the levels may be planar, there is no requirement for this, and, in most cases, the levels will not actually be planar.

In the first embodiment the decorative component 150 attached to the body inner roof surface 119 has a height less than the height of the inner wall surface 104, which elevates the decorative component 150 above the ground. In the fourth embodiment, the decorative component 150 attached to the body inner roof surface 119 (the roof of the grotto) will typically have a vertical height less than the vertical distance between the body inner roof surface 119 and the grotto floor 108.

Figure 28:
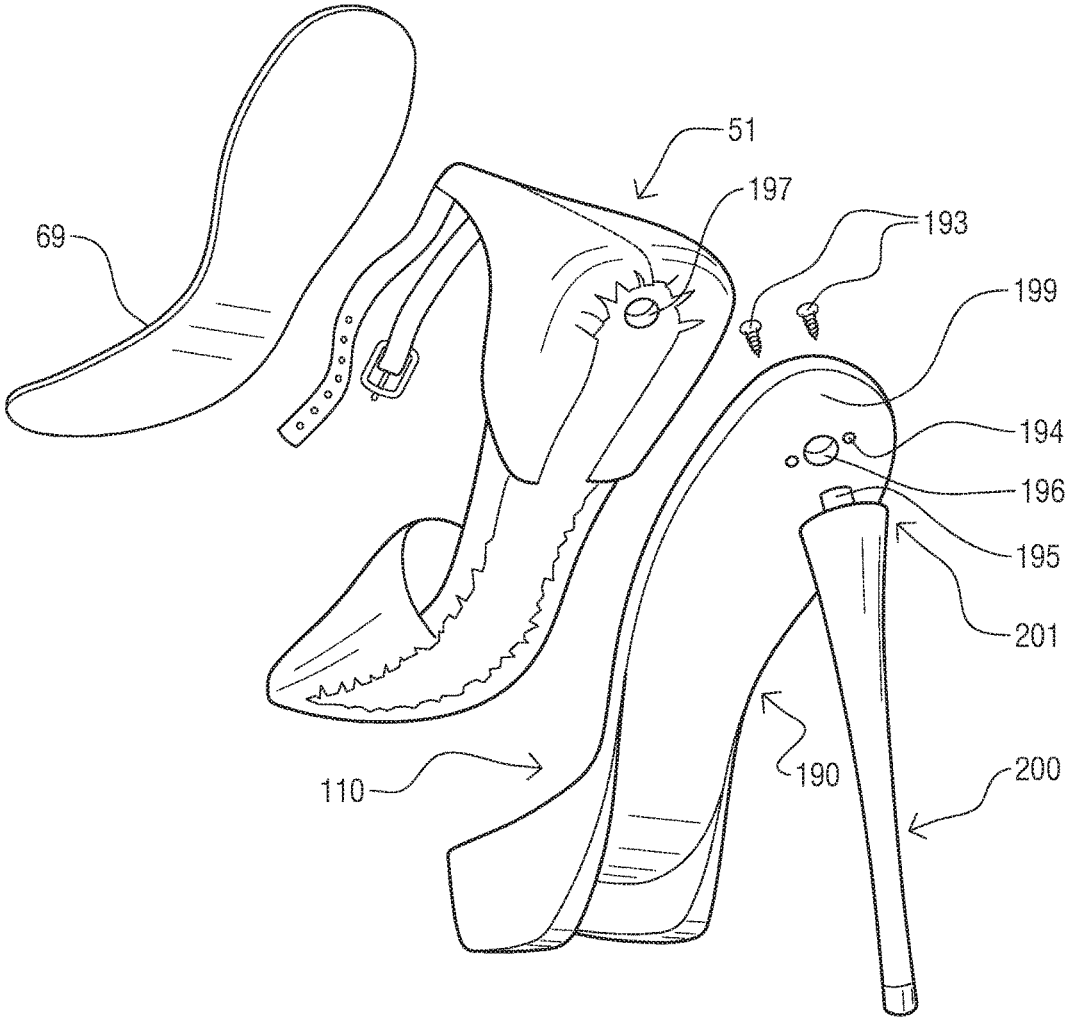
FIG. 28 is a perspective back view of a construction unit of the present invention having an elongated ramp and showing a first exemplary heel attachment aspect.
Figure 29:
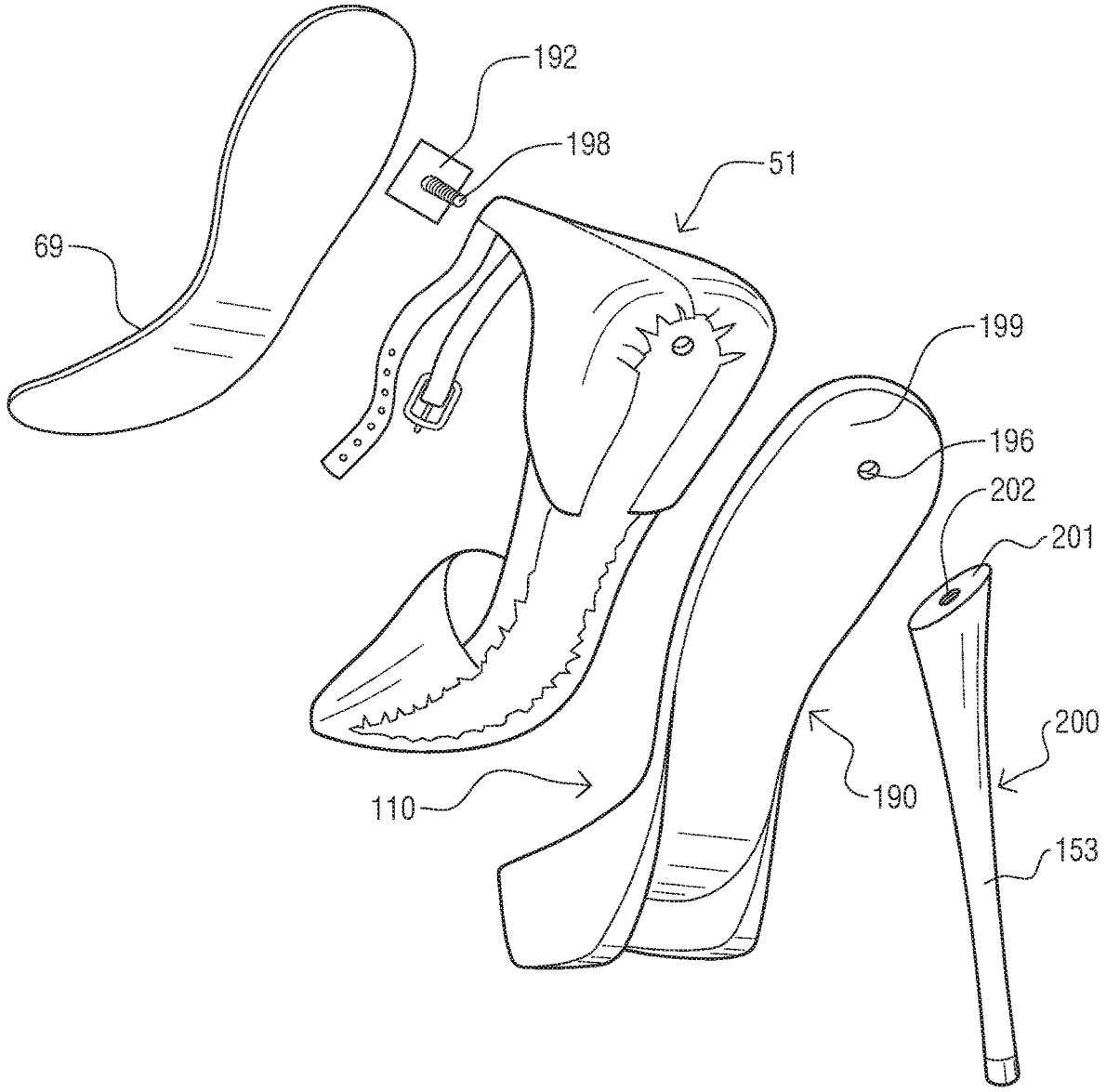
FIG. 29 is a perspective back view of a construction unit of the present invention having an elongated ramp and showing a second exemplary heel attachment aspect.

The fifth embodiment of the invention is shown in FIGS. 28-29. The fifth embodiment adds another area of the bottom of a shoe that can be utilized to display a portion of the decorative component 150. In the fifth embodiment, a heel 200 with a small base 201 is fixedly attached to the shoe. The use of a smaller base 201 than is typical for the heel permits the area around the heel, the perimetric margin 199, to additionally be available for receiving the decorative component 150. The perimetric margin 199 is a roughly flat area along the bottom of the heel portion of the shoe exterior of the heel 200. Though the small-base heel 200 is illustrated with a tall vertical support portion 153, a medium or short vertical support portion 153 is within the scope of the invention.

The fifth embodiment also illustrates that the toe construction unit 100 may be lengthened to form an extended construction unit 190 that includes the toe portion plus an arch extension and a heel extension with a heel bottom; the toe construction unit too, thus, is not limited to ending at the end of the wedge 117.

The small-base heel 200 is fixedly attached to the remainder of the shoe. It may be attached in various ways as is known in the art of shoemaking. Two exemplary attachment means are shown in FIGS. 28 and 29. FIG. 28 shows a peg 195 that corresponds to a receiving aperture 196. The peg 195 is inserted into the receiving aperture 196 (and may additionally extend into the aperture 197 of the upper) and may secured by adhesive and/or by mechanical devices 193. such as screws or monofilament, either of which may make use of the holes 194. FIG. 29 shows a second exemplary attachment means in which the heel 200 includes a concavity 202 aligned with an aperture 196 in the extended construction unit 190 and an aperture in a portion of the bottom of the upper 51. The heel 200 is attached mechanically and/or adhesively. For example, a bolt 198 (with a large head or base 192) may be installed to join the upper 51, the extended construction unit 190, and the heel 200. An insole 69 (and/or other inner shoe layers) may function to cover the base 192 of the mechanical attachment.

When the heel 200 is installed onto the finished shoe, the perimetric heel margin 199 exterior to the outer portion of the heel base 201 provides a foundation upon which the decorative component 150 may be directly or indirectly disposed. The decorative component 150 may be adhered directly to the perimetric heel margin 199, or the perimetric heel margin 199 may be covered by a suitable covering, such as is known in the shoemaker's art, with the decorative component 150 fixedly attached to or adhered to the suitable heel covering. Thus, the fifth embodiment adds an additional area to which a decorative component 150 may be displayed.

In all the embodiments, the decorative component 150 is attached securely to the underlying surface. In some aspects, the decorative component 150 may be attached via glue, adhesive, or other bonding agent. In an aspect, the decorative component 150 may be further secured with threading extending from the underlying portion of the shoe and engaged with the decorative component 150. In an example show in FIG. 22, the decorative component is rhinestones or rhinestone-like stones 170 disposed within cone-shaped receiving holes 175 that may be held within the receiving holes 175 with glue, adhesive, or mechanical settings. In an aspect, a pave-type setting may be used, in which multiple small stones, beads, or the like are closely set with minimal visibility of the metal prongs holding them in place to provide the look of a sparkly pavement.

In the aspect in which the decorative component 150 is disposed on or integrated into the inlay 172, the edges of the decoration-receiving areas may include a border ridge 115 that is sufficiently deep to hide the inlay 172. The border ridge 115 is disposed to obscure viewing of the inlay edge, so it is disposed in a location that allows it to cover the inlay's raw edge when the inlay is installed. For example, without a border ridge 115, if the inlay 172 is disposed on the peripheral inner wall 104 or on the recess wall encasing portion 181 covering the peripheral inner wall 104, the edge of the inlay 172 could be seen at the bottom of the shoe. In one aspect, the inlay 172 is to be disposed on the recess roof encasing portion 188 and the recess wall encasing portion 181 of the encasement 180, so a border ridge 115B is disposed at the intersection of the underside encasing portion 189 and the recess wall encasing portion 181 to hide the edge of the inlay 172, as can be seen in FIG. 21. In an additional aspect shown in FIGS. 20, 23, when the inlay 172 is installed it covers the recess roof encasing portion 188, which positions the edge of the inlay 172 adjacent to and/or abutting the recess wall 181; therefore, no border ridge 115 is needed or included at the junction of recess wall 181 and recess roof encasing portion 188. But as the inlay 172 extends across the arch and down the inner heel, a border ridge 115B is disposed along the outer edge of the arch encasing portion 185 and inner heel encasing portion 184 to hide the edge of the inlay 172. In one aspect as seen in FIG. 23, the border ridge 115B may run down both sides of the inner heel encasing portion 184 but may have an opening 199 at the end of the inner heel encasing portion 184, which may provide advantages in assembly.

Figure 2A:
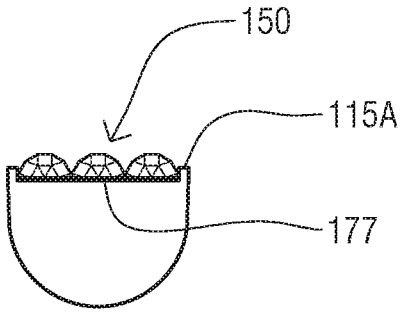
FIG. 2A is a cut view taken from lint 2A-2A of FIG. 2 of the embellished shoe of the present invention.
Figure 10:
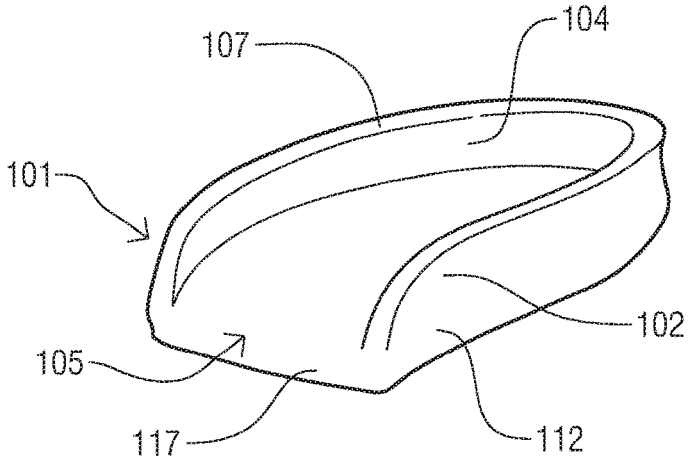
FIG. 10 is a perspective back view of the bottom of the construction unit of the present invention with a short, thin peripheral wall.

In a further aspect in which no encasement is included, the arch and heel may include a border ridge 115A to obscure viewing of the edge of the substrate 177, as seen in FIG. 2A. FIGS. 16-17 illustrate an aspect of the construction unit 110 with a border ridge 115A, while FIG. 10 illustrates an aspect of the construction unit 110 without a border ridge 115A.

Figure 24:
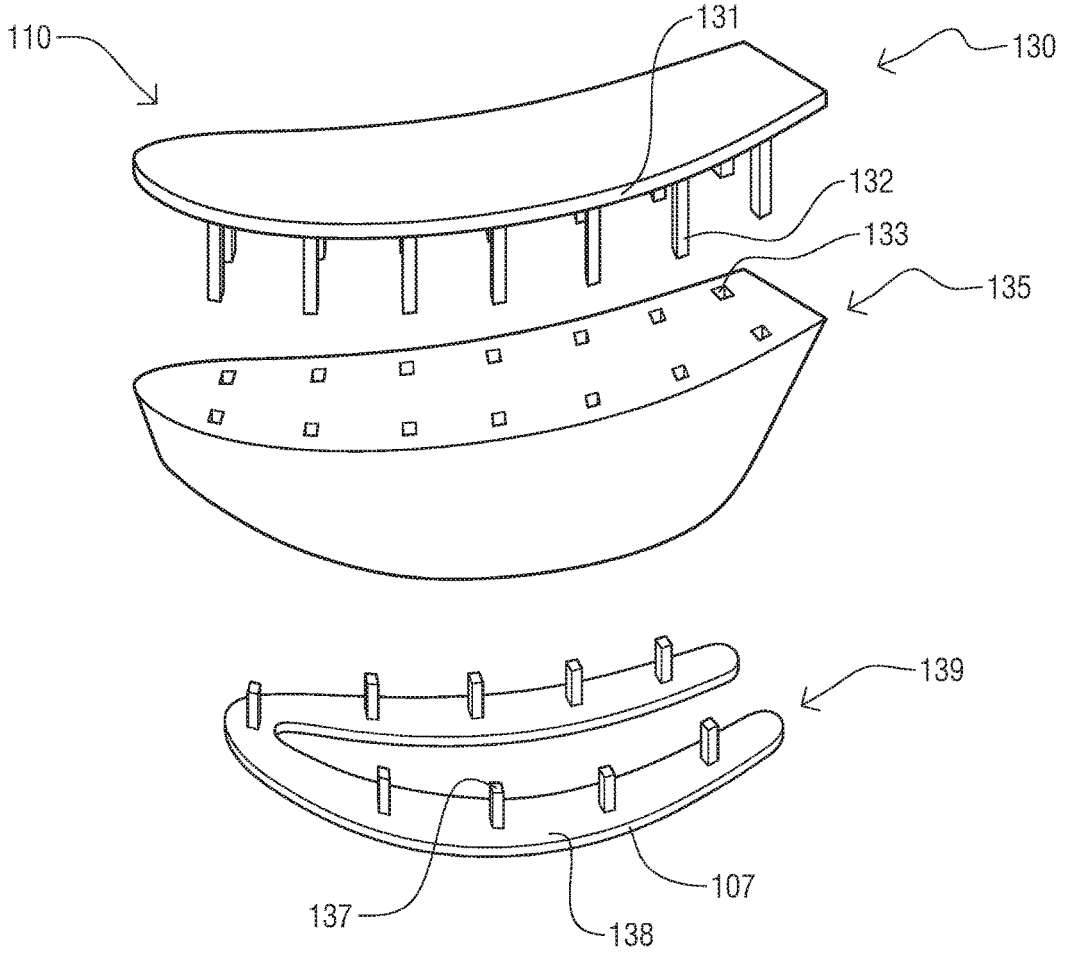
FIG. 24 is an expanded side perspective view of a construction unit including a shoe-unit interface, a modified construction unit, and a foundational base.

FIG. 24 illustrates a sixth embodiment. In this embodiment, the construction unit 110 is not formed unitarily, but comprises multiple portions. In one aspect the construction unit 110 comprises a mid-base 135, an upper shoe-unit interface 130, and a lower foundational base 139. In another aspect the construction unit 110 comprises a mid-base 135 and an upper shoe-unit interface 130 without the lower foundational base 139. The unit-to-shoe interface 130 is a thin structure that includes an interface foundation 131 and one or more downwardly-protruding projections 132 that extend downwardly from the interface foundation 131. The interface foundation 131 has a bottom surface that conforms substantially to the top of the mid-base 135 and has a top surface that conforms substantially to the portion of the shoe to which it will be attached. The lower foundational base 139 is a thin structure having a top surface that conforms substantially to the mid-base's bottom surface, having upwardly-protruding projections 137, and having a bottom surface for walking that is generally smooth and flat.

The mid-base 135 includes the upraised area 105 of the construction unit 110 of the first embodiment and additionally includes upper receiving holes 133 and lower receiving holes (not shown). The upper receiving holes 133 are sized and configured to receive the downwardly-protruding projections 132, which are to be fixedly attached within the upper receiving holes 133. The lower receiving holes are sized and configured to receive the upwardly-protruding projections 137, which are to be fixedly attached within the lower receiving holes. The upper receiving holes 133 may be offset from the downward receiving holes, particularly if the offsetting improves structural robustness.

The construction unit 110 of the sixth embodiment of FIG. 24 is utilized similarly to the construction unit 110 of the other embodiments, but it may provide advantages in weight reduction and/or in providing versatility in the use of different materials for different portions of the construction unit. The three elements of the construction unit 110 may be formed from the same materials, may be formed of two different materials, or may be formed of three different materials. In one aspect, the construction unit 110 is formed of a plastic resin or composite material, while the shoe-unit interface 130 and the foundational base 139 may be formed of a metal or metal alloy (for example, nickel alloy or titanium). In this case, the plastic and metal assembly will be of lighter weight than a construction unit that is formed unitarily of metal or metal alloy.

The construction unit 110 may be formed of plastic resins, metals, natural or synthetic wood, or a combination of materials. It may be formed unitarily, or it may be formed in parts that are permanently and non-removably joined together.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A shoe, comprising:

a toe section;

an arch section disposed rearwardly of said toe section;

a heel section disposed rearwardly of said arch section;

a decorative component; and a construction unit comprising:

an upper body extending rearwardly from a body front portion and extending between opposing body side portions; said upper body having a body top portion surface disposed generally at an upper first level and a body inner roof surface disposed generally at a second level that is below said first level;

a weight-bearing wall extending downwardly from said upper body; wherein said weight-bearing wall extends downwardly from at least a portion of said body front portion and opposing body side portions; wherein said weight-bearing wall terminates rearwardly at right and left back wall margins and terminates-downwardly in a wall bottom boundary lying substantially in a third level disposed below said second level; said weight-bearing wall having a wall interior surface and a wall exterior surface; and an upraised area defined at least partially by said wall interior surface and said body inner roof surface; wherein at least a portion of said decorative component is fixedly attached to said body inner roof surface and is elevated above said third level.

2. A shoe, comprising:

a toe section;

an arch section disposed rearwardly of said toe section;

a heel section disposed rearwardly of said arch section;

a decorative component; and a construction unit comprising:

an upper body extending rearwardly from a body front portion and extending between opposing body side portions; said upper body having a body top portion surface disposed generally at an upper first level and a body inner roof surface disposed generally at a second level that is below said first level;

a weight-bearing wall extending downwardly from said upper body; wherein said weight-bearing wall extends downwardly from at least a portion of said body front portion and opposing body side portions; wherein said weight-bearing wall terminates rearwardly at right and left back wall margins and terminates-downwardly in a wall bottom boundary lying substantially in a third level disposed below said second level; said weight-bearing wall having a wall interior surface and a wall exterior surface; and an upraised area defined at least partially by said wall interior surface and said body inner roof surface; and an encasement including a roof encasement portion attached to said body inner roof surface; wherein said encasement is configured to receive at least a portion of said decorative component.

3. The shoe, as recited in claim 2, further comprising:

an inlay attached to said roof encasement portion configured to receive at least a portion of said decorative component.

4. The shoe, as recited in claim 3, further comprising a border ridge; wherein said inlay comprises exterior edges; and wherein said border ridge hides said inlay exterior edges.

5. A shoe, comprising:

a toe section;

an arch section disposed rearwardly of said toe section;

a heel section disposed rearwardly of said arch section;

a decorative component; and a construction unit comprising:

an upper body extending rearwardly from a body front portion and extending between opposing body side portions; said upper body having a body top portion surface disposed generally at an upper first level and a body inner roof surface disposed generally at a second level that is below said first level;

a weight-bearing wall extending downwardly from said upper body; wherein said weight-bearing wall extends downwardly from at least a portion of said body front portion and opposing body side portions; wherein said weight-bearing wall terminates rearwardly at right and left back wall margins and terminates-downwardly in a wall bottom boundary lying substantially in a third level disposed below said second level; said weight-bearing wall having a wall interior surface and a wall exterior surface; and an upraised area defined at least partially by said wall interior surface and said body inner roof surface; wherein the height of said weight-bearing wall is greater than the height of said decorative component, whereby said decorative component is elevated above the ground.

6. The shoe, as recited in claim 5, wherein said decorative component comprises at least one of crystals, rhinestones, ceramic particles, glass particles, porcelain, a textile, sequins, mirrors, links of chains, metal, electroplated metal, fur, precious stones, semiprecious stones, an exotic skin, or leather.

7. The shoe, as recited in claim 5, wherein said construction unit further comprises an arch extension and a heel extension.

8. The shoe, as recited in claim 7, wherein:

said heel section comprises a centrally disposed heel;

said heel extension comprises a heel bottom surface disposed around said heel; and and at least a portion of said decorative component is disposed upon said heel bottom surface.

9. The shoe, as recited in claim 7, wherein said shoe further comprises a small-base heel that is fixedly attached below said heel extension of said construction unit.

10. A shoe construction unit for use in constructing a shoe comprising:

an upper body extending rearwardly from a body front portion and extending side-to-side between opposing body side portions; said upper body having a body top portion surface and a body inner roof surface; wherein said body top portion surface is disposed generally at a first level; and wherein said body inner roof surface is disposed generally at a second level that is below said first level;

a weight-bearing wall extending downwardly from at least a portion of said opposing body side portions and said body front portion, terminating rearwardly at right and left back wall margins having a gap therebetween said weight-bearing wall terminating; downwardly in a wall bottom boundary lying substantially in a third level disposed below said second level; said weight-bearing wall having a wall interior surface and a wall exterior surface;

an upraised area defined at least partially by said wall interior surface and said body inner roof surface; wherein said upraised area is elevated above said third level; and a grotto floor extending horizontally side-to-side between opposing sides of said wall interior surface and extending horizontally front-to-back from the front of said wall interior surface to a rearmost grotto floor edge; wherein said grotto floor is disposed at a fourth level above said third level and below said second level.

11. A shoe construction unit for use in constructing a shoe comprising:

an upper body extending rearwardly from a body front portion and extending side-to-side between opposing body side portions; said upper body having a body top portion surface and a body inner roof surface; wherein said body top portion surface is disposed generally at a first level; and wherein said body inner roof surface is disposed generally at a second level that is below said first level;

a weight-bearing wall extending downwardly from at least a portion of said opposing body side portions and said body front portion, terminating rearwardly at right and left back wall margins having a gap therebetween said weight-bearing wall terminating; downwardly in a wall bottom boundary lying substantially in a third level disposed below said second level; said weight-bearing wall having a wall interior surface and a wall exterior surface; wherein said right and left back wall margins taper in width forming a thin upper portion of said right back wall margin and a thin upper portion of said left back wall margin; and an upraised area defined at least partially by said wall interior surface and said body inner roof surface; wherein said upraised area is elevated above said third level.

12. The shoe construction unit, as recited in claim 11, comprising one or more openings disposed in said weight-bearing wall.

13. The shoe construction unit, as recited in claim 11, comprising one or more-openings extending through said weight-bearing wall from said wall interior surface to said wall exterior surface.

14. The shoe construction unit, as recited in claim 11, wherein said wall interior surface is generally vertical.

15. The shoe construction unit, as recited in claim 11, wherein said construction unit further comprises an arch extension and a heel extension.

16. The shoe construction unit, as recited in claim 11, further comprising a grotto including a grotto floor.

17. A shoe structural assembly for use in constructing a shoe comprising:

a decorative component; and a construction unit comprising:

an upper body extending downwardly from an upper body top surface, extending rearwardly from a body front portion and extending between opposing body side portions; said upper body having a body top portion surface disposed generally at an upper first level and a body inner roof surface disposed generally at a second level that is below said first level;

a weight-bearing wall extending downwardly from said upper body; wherein said weight-bearing wall is disposed below at least a portion of said body front portion and opposing body side portions; wherein said weight-bearing wall terminates rearwardly at right and left back wall margins and terminates downwardly in a wall bottom boundary lying substantially in a third level disposed below said second level; said weight-bearing wall having a wall interior surface and a wall exterior surface;

an upraised area defined at least partially by said wall interior surface and said body inner roof surface; wherein said upraised area is elevated above said third level; and an encasement including a roof encasement portion attachable to said body inner roof surface and a wall encasement portion attachable to said wall interior surface for receiving at least a portion of said decorative component.

18. The shoe structural assembly, as recited in claim 17, further comprising:

a shoe-unit interface shaped and configured to be fixedly attached to said shoe; said shoe-unit interface comprising multiple downwardly-protruding projections; and wherein said construction unit further comprises upper receiving holes sized and shaped to accommodate said downwardly-protruding projections.

19. The shoe structural assembly, as recited in claim 17, wherein said decorative component comprises at least one of crystals, rhinestones, ceramic particles, glass particles, porcelain, a textile, sequins, mirrors, links of chains, metal, electroplated metal, fur, precious stones, semiprecious stones, an exotic skin, or leather.

20. The shoe structural assembly, as recited in claim 17, wherein said construction unit further comprises an arch extension and a heel extension.

21. The shoe structural assembly, as recited in claim 20, wherein said heel extension is configured to receive a small-base heel.

22. The shoe structural assembly, as recited in claim 17, comprising one or more openings disposed in said weight-bearing wall.

23. A shoe, comprising:

a toe section;

an arch section disposed rearwardly of said toe section;

a heel section disposed rearwardly of said arch section;

a decorative component; and a construction unit comprising:

an upper body extending rearwardly from a body front portion and extending between opposing body side portions; said upper body having a body top portion surface disposed generally at an upper first level and a body inner roof surface disposed generally at a second level that is below said first level;

a weight-bearing wall extending downwardly from said upper body; wherein said weight-bearing wall extends downwardly from at least a portion of said body front portion and opposing body side portions; wherein said weight-bearing wall terminates rearwardly at right and left back wall margins and terminates-downwardly in a wall bottom boundary lying substantially in a third level disposed below said second level; said weight-bearing wall having a wall interior surface and a wall exterior surface; and a grotto including a grotto floor.

* * * * *